US006170480B1

(12) United States Patent
Melink et al.

(10) Patent No.: US 6,170,480 B1
(45) Date of Patent: Jan. 9, 2001

(54) COMMERCIAL KITCHEN EXHAUST SYSTEM

(75) Inventors: Stephen K. Melink; Darren L. Witter, both of Cincinnati, OH (US); Eric P. Bussy, Lyons (FR)

(73) Assignee: Melink Corporation, Cincinnati, OH (US)

( * ) Notice: Under 35 U.S.C. 154(b), the term of this patent shall be extended for 0 days.

(21) Appl. No.: 09/235,958

(22) Filed: Jan. 22, 1999

(51) Int. Cl.[7] ..... F24C 15/20

(52) U.S. Cl. ..... 126/299 R; 126/299 D

(58) Field of Search ..... 126/299 R, 299 D; 169/65; 250/574; 356/438

(56) References Cited

U.S. PATENT DOCUMENTS

| | | | | |
|---|---|---|---|---|
| 3,625,135 | * | 12/1971 | Carlson | 126/299 D |
| 3,723,746 | * | 3/1973 | Lawson et al. | 250/574 |
| 4,372,195 | * | 2/1983 | Dorius | 126/299 D |
| 4,903,685 | | 2/1990 | Melink | 126/299 |
| 5,697,450 | * | 12/1997 | Stehling et al. | 169/65 |

FOREIGN PATENT DOCUMENTS

2209070 * 4/1989 (GB) .

* cited by examiner

*Primary Examiner*—Ira S. Lazarus
*Assistant Examiner*—Sara Clarke
(74) *Attorney, Agent, or Firm*—Wood, Herron & Evans, LLP

(57) ABSTRACT

An air control system (33) for an exhaust system (32) of a commercial or institutional kitchen (12) of a facility (10) in which the volume rate of air exhausted may be increased to improve the comfort, health, and safety conditions in the kitchen (12) and the rest of the facility (10). Comfort, health or safety may be determined by sensing a parameter in the ambient air environment (28), such as temperature and/or gas level. With the exhaust system (32) operating at a first volume rate to handle the activity of the cooking units 18, the air control system (33) causes exhaust system (32) to increase the volume rate toward a second, higher volume rate to exhaust more air from the ambient air environment (28) thereby reducing the temperature or gas level in the facility (10) to improve comfort and reduce load on a HVAC system (30) or to improve air quality which has health and safety benefits as well. Advantageously, the air control system (33) monitors exhaust temperature for an exceedance of a heat threshold, in which case fire control measures are taken.

87 Claims, 8 Drawing Sheets

COMMERCIAL KITCHEN EXHAUST SYSTEM

BACKGROUND OF THE INVENTION

The present invention relates to commercial and institutional kitchen exhaust systems, and more particularly, to an exhaust rate control method and apparatus for such exhaust systems.

Commercial and institutional kitchens are equipped to prepare food for large numbers of people and may form part of or adjoin larger facilities such as restaurants, hospitals and the like. Such kitchens are typically equipped with one or more commercial duty cooking units capable of cooking large amounts of food. On such a scale, the cooking process may generate substantial amounts of cooking heat and airborne cooking by-products such as water vapor, grease particulates, smoke and aerosols, all of which must be exhausted from the kitchen so as not to foul the environment of the facility. To this end, large exhaust hoods are usually provided over the cooking units, with duct work connecting the hood to a motor driven exhaust fan located outside the facility such as on the roof or on the outside of an external wall. As the fan is rotated by the motor, air within the kitchen environment is drawn into the hood and exhausted to the outside atmosphere. In this way, cooking heat and cooking by-products generated by the cooking units follow an air flow path defined between the cooking units and outside through the hood to be exhausted from the kitchen before they escape into the main kitchen environment and perhaps into the rest of the facility.

In many conventional installations, the motor driving the exhaust fan rotates at a fixed speed. The exhaust fan thus rotates at a fixed speed as well and, therefore, tends to draw air through the hood at a constant or fixed volume rate. However, the amount of cooking heat and/or cooking by-products generated by the cooking units will vary widely over the course of the day. It has been the practice in such instances to select a speed for the fan that will cause the system to exhaust a fixed volume rate of air based on the level of cooking heat and/or cooking by-products expected to be generated during anticipated peak usage of the cooking units. If the volume rate selected is too low, there will be times when the quantity of cooking by-products being generated exceeds the exhaust rate of the exhaust system. In such circumstances, the system will be in a relative under-exhaust state such that cooking by-products will be released into the kitchen. The fixed volume rate is thus selected to be sufficiently large that under most normal operating situations, all of the cooking by products, for example, will be expelled out of the hood rather than released into the kitchen. As a consequence, during non-peak times, the exhaust fan is running faster than required so it tends to be in an overexhaust state wherein the volume rate of air being expelled is more than is necessary to clear the cooking by-products from the kitchen. In many exhaust conditions, as air is expelled through the hood, other air is drawn into the kitchen, such as from a make-up air system or the rest of the facility, which in turn draws in air from outside the facility. The heating, ventilating, and air conditioning ("HVAC") system of the facility must typically condition the drawn-in air. During overexhausting, the HVAC system may be heavily taxed to condition the drawn-in air. Thus, over-exhausting has generally been recognized as uneconomical due to increased power usage by the exhaust system, reduced life of components such as the exhaust fan motor, and increased load on the HVAC system.

In order to prevent uneconomical overexhausting, I developed a system by which to vary the speed of the exhaust fan in accordance with the level of heat and/or by-products being generated by the cooking units. Such a system is described in my U.S. Pat. No. 4,903,685, the disclosure of which is hereby incorporated by reference in its entirety. In that system, when little or no cooking is occurring such that the level of heat, for example, being generated by the cooking units is extremely low, the speed of the fan is held low to expel air from the kitchen at a low volume rate. As cooking increases, the level of cooking heat also increases, and the speed of the fan is increased to increase the volume rate of air expelled from the hood to the outside. Consequently, the volume rate of air being expelled is generally proportional to the level of cooking heat being generated. The system may additionally, or alternatively, vary the volume rate in correlation to the level of cooking by-products being generated by the cooking units. In some situations, when any cooking by-product is detected, the exhaust volume rate may be forced to a high level, such as maximum, irrespective of the cooking heat level or variations in the level of cooking by-product. Varying the volume rate of air exhausted is expected to generally improve the energy efficiency of the facility. The foregoing notwithstanding, varying the volume rate solely based on the activity of the cooking units fails to account for opportunities to improve the comfort or enhance safety in the kitchen or other parts of the facility.

By way of example, there are typically substantial periods of time during which little or no cooking is being undertaken. During these idle times, the volume rate of air being exhausted will typically be quite low or even zero. Nonetheless, an ambient air environment away from the hood and air flow path but within the main area of the kitchen can still become quite hot. A typical HVAC system may require significant amounts of energy to cool the kitchen down to a more comfortable level and could also cause the rest of the facility to become uncomfortably cold. Conversely, as the HVAC system heats the facility, the kitchen may be caused to become uncomfortably hot. Similarly, the ambient air environment may become uncomfortable and/or unsafe due to build up of noxious gases or other harmful agents. For example, carbon dioxide may increase in the ambient air environment, particularly in the dining room, for example, due to the number of occupants of the facility. The above problems can also be encountered during non-idle times such that exhausting at a volume rate sufficient to exhaust cooking heat, for example, will not be sufficient to cool the kitchen or clear noxious gases.

SUMMARY OF THE INVENTION

The present invention provides an exhaust system and method which improves the comfort or enhances safety in the kitchen or other parts of the facility. To this end, and in accordance with the principles of the present invention, while the system is exhausting air at a first volume rate, the volume rate of air being exhausted is selectively increased toward or to a second, higher volume rate in response to conditions in the ambient air environment becoming uncomfortable, unhealthy, and/or unsafe. More particularly, while the exhaust system is exhausting air at the first volume rate (which could be a preset rate or varied to correlate to cooking heat and/or cooking by-product levels, for example), in response to a parameter of the ambient air environment exceeding a desired comfort threshold, the system is caused to increase the volume rate of air being expelled so as to increase air drawn out of the ambient air environment through the hood which thus reduces the load on the HVAC system, for example, or to increase the quality of the ambient air environment. The parameter may be temperature, in which case the ambient air environment temperature is sensed such that the increase in volume rate is undertaken when the kitchen gets uncomfortably warm as indicated by the sensed temperature exceeding a desired comfort threshold, such as 75° F. by way of example. Alternatively, or additionally, the parameter may be gas level, in which case the ambient air environment gas level is sensed such that the increase in volume rate is undertaken when the dining room, for example, becomes fouled with noxious gases above a desired comfort threshold, such as 100 ppm $CO_2$, by way of example. The ambient air environment parameters may be used to increase the volume rate by a preset amount from the first volume rate or to a preset volume rate, or may increase from the first volume rate by an amount correlated to the amount by which the parameter exceeds the threshold. Other parameters could be utilized as well, such as humidity, airborne pathogens, or odors, to name a few.

The increased volume rate of exhaust may be maintained until the parameter(s) of concern returns to or below the threshold, or may vary as the second parameter varies, and then reduces toward the original volume rate. Advantageously, and to avoid sudden cycling of the motor and/or unsettling variations in noise or air flow, the volume rate is increased or decreased in a ramped fashion over respective time intervals such as up to one minute.

In some situations, it may be useful not to increase the volume rate in response to the ambient air environment inside the facility. By way of example, where the increase is intended to cool the kitchen, if the outside air temperature is too high, the desired cooling effect may not result. Instead, the HVAC system may be taxed while the kitchen becomes even more uncomfortable. To this end, and in accordance with a further aspect of the present invention, if the outside temperature is above a selected temperature, which may again be 75° F. by way of example, the first volume rate is maintained irrespective of the kitchen temperature.

As an additional comfort function, the variation in volume rate based upon cooking heat may include a winter set back function. To this end, it will be appreciated that the volume rate typically varies relatively linearly between a minimum volume rate and a maximum volume rate over a range of exhaust temperatures such as 75° F. to 110° F. Where the outside temperature is quite cool, such as in the winter, it may be advantageous to increase the minimum exhaust temperature at which volume rate variations begin or to reduce the minimum volume rate, the change being referred to as a winter setback. To this end, if the outside temperature is below a selected temperature, such as 75° F. by way of example, the winter set back is active to thus reduce the effective volume rate of exhaust air where the outside environment is relatively cool.

Another, and perhaps more important, factor is fire safety. As is well recognized, kitchens can often be the source of fire, especially grease fires. At present, a conventional approach to managing kitchen fires relies on user action to douse the fire such as with a dry chemical fire extinguisher and/or automatic fire suppression systems such as sprinkler or chemical expulsion systems which trigger in response to extreme heat conditions. In both cases, the action taken is usually irreversible and may come too late to bring the fire under control without professional assistance such as from fire department personnel. The present invention provides, as an additional feature, a fire control system and method in which the level of cooking heat is monitored, and if it exceeds a first heat threshold which is outside the normally expected safe range for cooking, the energy source to the cooking unit is interrupted so as to affect a shut down of the cooking unit and thereby potentially avert a fire in the making. Where the energy source is gas, an open valve in the gas line may be closed to interrupt the energy source to the cooking unit. Where the energy source is electric, a closed relay may be opened to interrupt the energy source to the cooking unit. The cooking heat level may continue to be monitored for a second heat threshold, which could be a higher temperature than the first heat threshold (such as where the first heat threshold is below a level normally indicative of fire) and/or a time duration over which the level of heat continues to exceed the first threshold. If the second heat threshold is satisfied, the conventional fire suppression systems may be activated.

As will be appreciated, the level of generated cooking heat is readily monitored in the hood duct as shown in my aforementioned U.S. Patent. While that temperature is typically monitored for varying the range of volume rate of air exhausted by the system (e.g., the first volume rate), the fire control function may be provided by monitoring the same temperature point without the need for additional sensing equipment or the like. Further enhancements to the sensors may also be provided. For example, the cooking by-product level is monitored by light-based sensors, such as an infrared sensor as described in my aforementioned patent. During use, some amount of cooking by-product tends to pass immediately over the sensor components, and may tend to coat the active sensor components, such as the optical lenses thereof, thereby building up an accumulation of fouling components which reduce the effectiveness of the sensors. While purge air swept directly over at least an active portion of the sensor(s) such as the lenses thereof may reduce accumulations, purge air generally does not entirely eliminate the build up. In accordance with another feature of the present invention, the sensor capability is enhanced by use of a laser beam rather than an infrared beam. The laser beam is more tolerant of fouling accumulation, allows for more reliable calibration, and can tranverse a wider hood. Also, where the beam is a laser beam of visible light, it is easily seen by the installer and so may be more reliably aimed at the detector during installation or servicing.

By virtue of the foregoing, there is thus provided an exhaust system and method which improves the comfort or enhances the quality of the kitchen environment or other parts of the facility, such as by selectively increasing the volume rate of air being exhausted in response to conditions in the ambient air environment becoming uncomfortable, unhealthy, and/or unsafe. The exhaust system and method of the present invention thus may improve the energy efficiency of the facility while also providing a wider range of flexibility in the management of the kitchen environment. These and other objects and advantages of the present invention shall be made apparent from the accompanying drawings and the description thereof.

BRIEF DESCRIPTION OF THE DRAWINGS

The accompanying drawings, which are incorporated in and constitute a part of this specification, illustrate embodiments of the invention, and, together with the general description of the invention given above, and the detailed description of the embodiments given below, serve to explain the principles of the present invention.

DETAILED DESCRIPTION OF THE INVENTION

Figure 1:
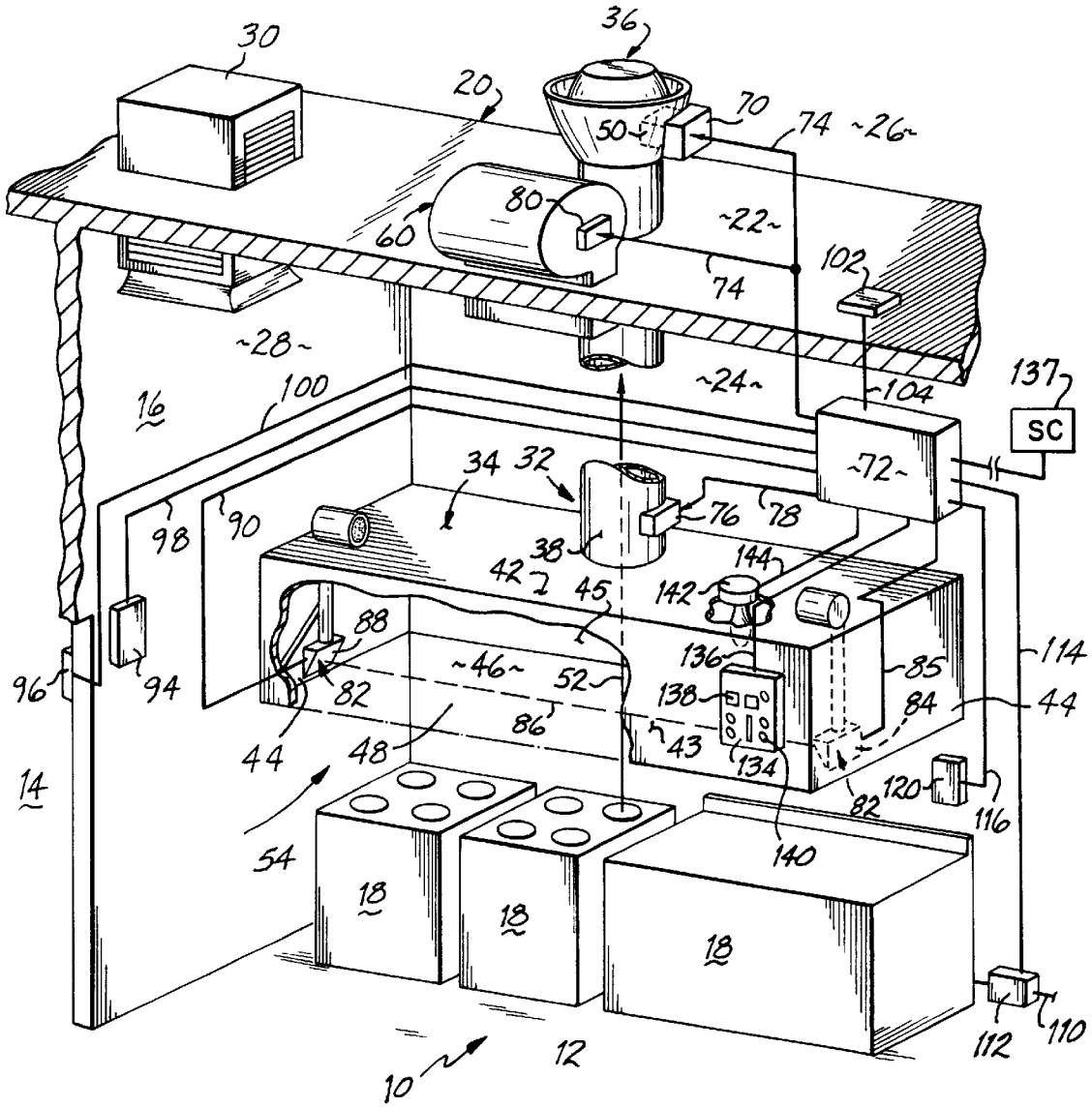
FIG. 1 is a perspective view diagrammatically illustrating a restaurant or institutional facility, primarily the kitchen area and cooking units thereof, and including a kitchen exhaust system according to the principles of the present invention.

Referring to FIG. 1, a facility 10 such as a restaurant or institutional facility includes a kitchen 12 and at least one adjacent room such as a dining room 14 with an interior wall 16 separating the two rooms 12, 14. Kitchen 12 includes a plurality of commercial cooking units 18 such as one or more stoves, ovens, griddles and the like. The facility 10 is surrounded by an enclosure 20 (defined by a roof 22 and exterior walls 24 only one of which is shown in FIG. 1) which separates the outside environment 26 from the inside ambient air environment 28 of facility 10 including kitchen 12. Facility 10 is also equipped with a heating, ventilating and air conditioning system ("HVAC") as at 30 which maintains the inside environment 28 at a suitable condition for the use of the occupants of facility 10.

Associated with kitchen 12 is kitchen exhaust system 32 including an exhaust hood 34 situated over the cooking units 18 and communicating with an exhaust assembly 36 through a duct 38. Hood 34 may be generally rectangular with a top wall 42 and depending front, sides and back walls 43, 44 and 45 to define an internal volume 46 which communicates through a downwardly facing opening 48 to cooking units 18. Volume 46 also communicates with exhaust assembly 36 via exhaust duct 38 connected through top wall 42. A filter assembly (not shown) may be installed in hood 34 to filter air pulled into duct 38 by assembly 36 as is well understood. Exhaust duct 38 extends upwardly through the roof 22 of enclosure 20 and terminates in exhaust assembly 36 by which to exhaust air from volume 46 to the outside environment 26. Exhaust assembly 36 may include a fan motor and associated fan 50 as is well understood by which to expel air from assembly 36 at a volume rate. Thus, when motor 50 is running, an air flow path 52 is defined between cooking units 18 and outside environment 26 through downwardly facing opening 48 of the hood 34, the internal volume 46 thereof, and duct 38. As air follows the air flow path 52, cooking heat and cooking by-products generated by the cooking units 18 are drawn along to be exhausted to the outside environment 26 rather than into the rest of the facility 10. Air exhausted along the air flow path 52 is replaced by air from the ambient air environment 28 (which is defined as being outside of hood 34 and spaced away from air flow path 52) such that air is also drawn from environment 28 through hood 34 as indicated by arrow 54.

Facility 10 also includes a make-up air system represented diagrammatically at 60 to bring air from the outside environment 26 to the ambient air environment 28 within kitchen 12 to compensate for the volume of air exhausted by the exhaust system 32. In addition, facility 10 may be generally air tight for energy efficiency such that make-up air system 60 reduces undesirable drafts at openings in the enclosure 20. For example, an unlatched inward-swinging entrance door (not shown) into the facility 10 may be drawn open by the draft or an outward-swinging entrance door may be hard to open. Make-up air system 60 may be adapted to provide air in the vicinity just outside of the hood 34 to reduce the amount of air exhausted that has been conditioned by the HVAC system 30. Alternatively, make-up air 60 may be introduced into other locations within kitchen 12 specifically, or facility 10 generally, as will be readily understood.

In order to provide energy efficient operation, system 32 is provided with an air control system 33 (FIG. 2) by which system 32 is adapted to exhaust air at a plurality of volume rates. To this end, a motor speed controller 70, such as a GE/Fuji model C9, M$11, or E$, is provided by which to vary the speed of motor and thus its associated fan 50 so as to vary the volume rate of air exhausted through exhaust assembly 36. Although a variable speed motor 50 and motor speed controller 70 will advantageously provide a wide range of volume rates, the system could be adapted to drive motor 50 to exhaust at two selected volume rates, e.g., low and high, or over a discrete number of volume rates. Moreover, a magnetic starter may be substituted for the motor speed controller 70 as is generally understood.

A control module 72 is also provided in air control system 33 to couple volume rate signals over cable 74 to controller 70 by which to affect the volume rate variations. Ordinarily, when system 32 is on, control module 72 will send volume rate signals to controller 70 so as to cause exhaust system 32 to exhaust air at a first volume rate, such as a predetermined rate for typical cooking conditions or a variable rate correlated to the level of cooking heat and/or cooking by-product being generated by cooking units 18, the latter being in accordance with my aforementioned U.S. Patent.

With respect to varying the volume rate based on heat generation, the level of heat generated may be sensed by a temperature sensor 76 adapted to sense temperature in the air flow path 52 such as within duct 38. The sensed temperature is coupled as an electrical signal over cable 78 to control module 72. The electrical signal or cable 78 is used by control module 72 to vary the volume rate signals to controller 70 such that motor 50 runs the associated fan 50 to expel a volume rate of air correlated to the level of cooking heat being generated to thereby expel the cooking heat being generated and avoid a build-up of excess heat in kitchen ambient air environment 28. The correlated volume rate advantageously achieves that result without significant overexhausting to minimize drawing out of environment 28 any more air than is necessary to exhaust the cooking heat. While sensor 76 could be either analog or digital, it should have a heat rating sufficiently high to withstand the heat levels normally encountered in the kitchen and around cooking units 18. Typically, a temperature rating of about 392° F. may be required for use toward the top of the internal volume 46 or in the duct 38 whereas a typical rating of about 1000° F. may be required for use near the downwardly-facing opening 48 closer to the cooking units 18. The volume rate of make-up air provided by system 60, if one is available, may also be varied in accordance with the level of volume rate exhausted. For this purpose, the volume rate signals 74 from control module 72 may also be coupled to a controller 80 on make-up air system 60 so as to track the exhaust volume rate.

Alternatively, or in addition to determining the volume rate of air exhaust based on cooking heat, the volume rate of air exhausted may also be correlated to the level of cooking by-products being generated by cooking units 18. Sensing of cooking by-product is accomplished with a by-product sensor 82 by which to detect such cooking by-products as water vapor, grease particulates, smoke and aerosols generated by the cooking units 18. The cooking by-product sensor 82 is placed within the internal volume 46 of the hood 34, with an emitter 84 placed on one side wall 44 of the hood 34. The emitter 84 is powered over cable 85 and aligned to send a light beam traversing a portion of the internal volume 46 along a light beam path 86 to a detector 88 placed on an opposite side wall 44 of the hood 34. Having the light beam path 86 traverse the longitudinal length of the hood 34 provides for an accurate measurement of the cooking by-products since the path 86 passes above each of the plurality of cooking units 18 and, advantageously, just outside of the normal air flow path 52 as shown in my aforementioned U.S. Patent such that cooking by-product will not interrupt light beam path 86 unless the levels thereof exceed what is being exhausted by assembly 36 at the then-current first volume rate. Sensor 82 will output by-product signals over cable 90 to control module 72 corresponding to the level of by-product interrupting light beam path 86. Control module 72 utilizes the by-product signals 90 along with, or alternatively to, the heat level signals 78, to cause controller 72 to vary the volume rate of air exhausted by exhaust system 32. In some areas, zoning or other requirements may not permit variable volume rates with respect to cooking by-product level and so only heat generation may be utilized for varying the volume rate for normal cooking conditions. In those situations, detection of cooking by-product may instead be used to force the exhaust system 32 to exhaust at a pre-set high volume rate, such as at the second volume rate as will be hereinafter discussed, for either a preset interval (such as 60 to 90 seconds) or until the cooking by-product levels are reduced. In those cases, a smoke cleaning device SC 137 may also be turned on for the preset interval.

In those situations where the exhaust system 32 is operating to exhaust air at a first volume rate, which is either preset or which varies in correlation to cooking heat level and/or cooking by-product level, it will be appreciated that there is a significant amount of time during which system 32 is running at relatively low volume rates. As a consequence, there is headroom available, if appropriate, to increase the volume rate of exhaust toward or all the way to a second, higher volume rate, such as up to 100% or maximum. During those times when the system 32 is running below the second volume rate, energy efficiency is often obtained, but sometimes at the expense of the comfort or safety of those within facility 10. Thus, while system 32 is exhausting at say 20% to 60% of capacity, by way of example, it is possible that kitchen 12 is becoming uncomfortably warm or hot and/or noxious gases, such as $CO_2$, are building up within facility 10 such as in dining room 14.

In accordance with the principles of the present invention, a parameter of the ambient air environment 28, such as temperature or gas level, is sensed such as with a temperature sensor 94 communicating with the ambient air environment 28 in kitchen 12 (such as by mounting on wall 16 inside kitchen 12 and spaced well away from cooking units 18 and hood 34) and/or a gas level sensor 96 communicating with the ambient air environment 28 in facility 10 and advantageously outside of kitchen 12 such as by mounting on wall 16 in dining room 14. The temperature level from sensor 94 and/or the gas level from sensor 96 are communicated over respective cables 98 and 100 to control module 72 whereat they are evaluated against a desired comfort threshold for the respective parameter. If the threshold is exceeded by the sensed parameter, that condition suggests that the volume rate of air being exhausted must be increased to draw more air out of environment 28 to thereby reduce the temperature thereof and/or reduce the noxious gas levels therein. As a consequence, control module 72 sends a volume rate signal 74 to controller 70 to cause the exhaust volume rate to automatically force toward or all the way to a second volume rate which is greater that the current volume rate. The second volume rate may, up to the 100% maximum volume rate for system 32, be either a percentage or volume increase over the current first volume rate or may be a preset second volume rate. The preset volume rate could be the maximum rate although other volume rates below maximum could be utilized.

The desired comfort threshold for ambient air environment temperature is based upon a temperature indicative of kitchen 12 being uncomfortably warm. In one embodiment, that temperature is selected as 75° F., although other or different temperature thresholds could be selected. Similarly, the desired comfort threshold for ambient air environment gas level is based upon health, safety and/or comfort concerns. For example, where large groups gather, $CO_2$ levels may build up. In such situations, a gas level of 100 ppm $CO_2$ may be selected, although it will be appreciated that other or different gas levels, and types of gas, could be selected. As will also be appreciated, in those situations where the volume rate directed by control module 72 based on sensor 94 and/or 96 is already at or above the second volume rate, then no further increase in the volume rate is necessary. Also, to avoid rapid cycling, and to reduce noise or other drawbacks associated with sudden speed changes, the volume rate is advantageously increased in a ramp-wise fashion from the current or first volume rate toward the second volume rate, such as over a period of up to one minute.

The second volume rate may be maintained until the sensed ambient air environment temperature or sensed ambient air environment gas level returns to normal, such as below the associated threshold. Thereafter, or during the ramp up toward the second volume rate, if the parameter returns to normal, the volume rate is decreased toward the first volume rate, although not necessarily to the same volume rate as was in place before the increase since the cooking heat and/or cooking by-product levels may have changed necessitating a new first volume rate. Also, as with the increase in volume rate, the decrease in rate is advantageously accomplished in a ramp-wise fashion such as over a period of up to one minute. As an alternative, the ambient air temperature may be sensed to determine when to increase toward the second volume rate for comfort, while the gas level could be monitored to also increase the volume rate by an amount correlated to the sensed gas level. While either or both of the parameters of kitchen ambient air environment temperature and facility ambient air environment gas level are sensed, it will be appreciated that other ambient air environment parameters could, additionally or alternatively, be sensed and utilized by control module 72 to affect an increase in volume rate to rid the ambient air environment 28 of excesses of such parameters. By way of example, and not limitation, other such parameters include humidity, airborne pathogens, and odors to name a few.

In some situations, even where the first volume rate set in response to cooking heat levels, for example, has not reached or exceeded the second volume rate, it may be useful not to increase the volume rate toward the second volume rate in response to the ambient air environment temperature exceeding the threshold. By way of example, where the increase is intended to cool the kitchen 12, if the outside air temperature is too great, the desired cooling effect may not result. Instead, the HVAC system 30 may be taxed while the kitchen 12 becomes even more uncomfortable. To this end, and in accordance with a further aspect of the present invention, an outside temperature sensor 102 senses temperature correlated to the outside environment. Sensor 102 may be placed outside of facility 10 such as on roof 22 as shown in FIG. 1, or may otherwise communicate with the outside air such as within make-up air system 60. A signal representative of the outside temperature is coupled over cable 104 to control module 72. If the outside temperature as indicated on cable 104 is above a selected temperature, which may also be 75° F. by way of example, the first volume rate is maintained irrespective of the kitchen ambient air environment temperature as indicated by sensor 94.

When the outside temperature is quite cool, such as in the winter, varying the first volume rate correlated to the cooking heat levels may also be modified. Typically, the volume rate of air exhausted in correlation to the level of cooking heat (i.e., the temperature as indicated by sensor 76) will vary between a minimum volume rate when the cooking heat, i.e., the exhaust temperature, is below a first threshold such as 75° F. and will vary linearly therebetween to a maximum upper limit such as at or above 90° F. although the upper limit could be as high as 150° F. When the outside temperature is cool, however, it may be advantageous to maintain the minimum volume rate until a higher or second threshold is reached which is above the first threshold but still below the upper limit, or to reduce the minimum volume rate. To this end, if the outside temperature indicated on cable 104 is below a selected temperature, such as 75° F., a winter setback is activated in which the volume rate is held to a minimum until the exhaust temperature exceeds the second threshold, such as 80° F. or 85° F., above which the volume rate will vary linearly with exhaust heat level to the upper level. Alternatively or additionally, the winter setback is accomplished by reducing the minimum volume rate by about 10 to 20%.

To further maintain control of heat levels, when make up air is provided by system 60, the exhaust volume rate may be correlated to a cooking heat level temperature adjusted for make-up air effects. To this end, the product of percentage of make-up air times the outside temperature sensed by sensor 102, plus the product of percentage of exhaust air (1 minus the percentage of make-up air) times the cooking heat level sensed by sensor 76 is used to provide a compensated temperature to which the exhaust volume rate is correlated instead of the actual temperature from sensor 76.

In accordance with a further feature of the present invention, the kitchen exhaust system 32 provides for fire safety, which is especially useful since the cooking units 18 may be a source of fire. To this end, cooking units 18 are typically coupled to a source of energy 110, such as gas or electricity, via a coupling element 112 whereby to energize cooking units 18. Where the source 110 is gas, coupling element 112 may include a valve which is normally open to interconnect cooking units 18 to the gas. Where the source 110 is electricity, coupling element 112 may include a relay which is normally closed to interconnect cooking units 18 to the electricity. The normal state of coupling element 112 (e.g., open for a gas valve or closed for an electrical relay) may be altered or switched (e.g., to close the valve or open the relay) so as to interrupt energy source 110 to the cooking units 18 in the event of a potential fire. In this regard, cooking heat levels sensed by sensor 76 are utilized by control module 72 to alter the state of coupling element 112 under certain circumstances. More particularly, the heat level signal 78 is monitored and if it exceeds a first heat threshold which is outside the normally expected safe range for cooking, then a fire may be starting or underway. Control module 72 sends a signal over cable 114 to interrupt the energy source 110 to cooking units 18, such as by closing the valve or opening the relay of coupling element 112. The cooking units 18 are thus de-energized or shut down to thereby potentially avert a fire in the making.

The cooking heat level is further monitored against a second heat threshold which, if exceeded, causes control module 72 to send a signal such as over cable 116 to activate a conventional fire suppression system indicated diagrammatically at 120. The fire suppression system 120 could be a dry chemical or inert pressurized gas dispersion system and/or a water sprinkler system in the vicinity of units 18 as is well understood. The second heat threshold may be a higher temperature than the first heat threshold, with the first heat threshold being below a level normally indicative of fire, albeit elevated well above normal cooking heat levels. In this regard, the first and second heat thresholds, where heat level is sensed by sensor 76 associated with duct 38, may be 400° F. and 450° F., respectively. Alternatively, the second heat threshold may be a time duration over which the level of heat continues to exceed the first heat threshold to thus indicate that a fire condition may be in place.

Figure 2:
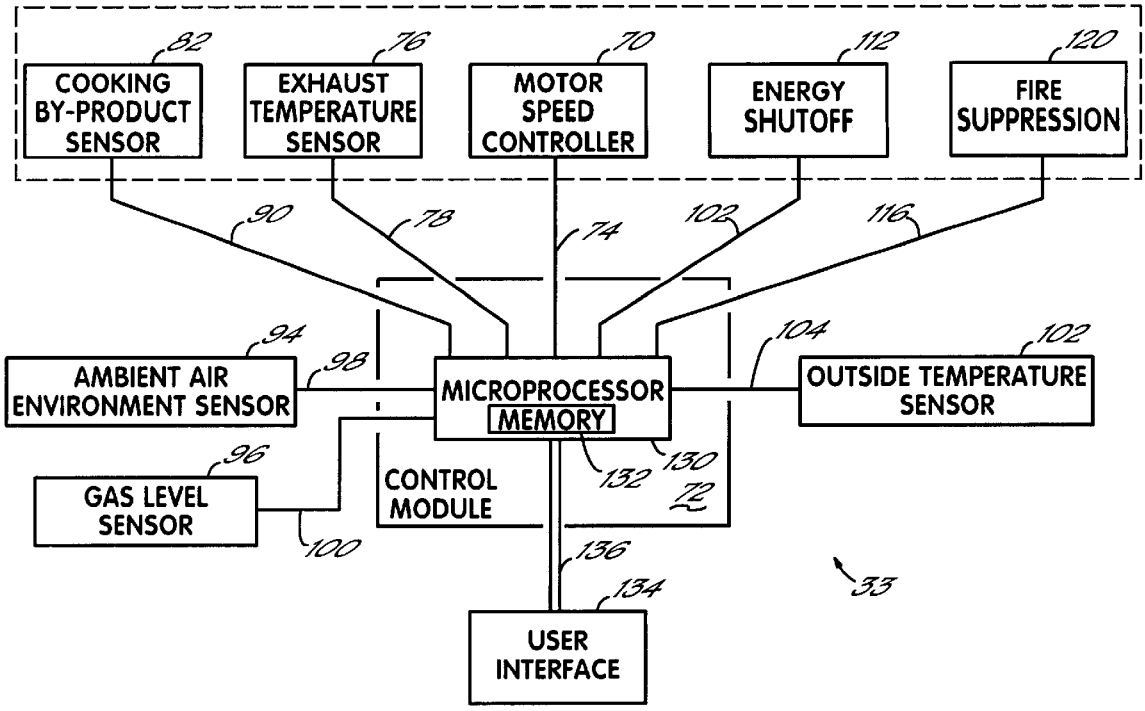
FIG. 2 is a block diagram of an exhaust system for use in the kitchen exhaust system of FIG. 1.

With further reference to FIG. 2, it may be seen that control module 72 of system 33 may include a microprocessor-based component or controller 130, such as a model 807C52 microprocessor manufactured by Intel, with associated memory 132 which receives the signals from the various sensors 76, 94, 96, 82, and 102 and generates signals to the motor controller 70 (and 80) and coupling element 112 to achieve the above-described functions. By providing microprocessor capability in control module 72, the various functions of systems 32 and 33 may be adjusted and more reliably controlled. Thus, the desired comfort threshold(s), selected outside temperature(s) and/or heat thresholds may be programmed into the processor system 130, such as via a user interface 134 which may be a keyboard/display unit mounted to front wall 43 of hood 34 and coupled to control module 72 by cable 136 as seen in FIG. 1. Interface 134 may include a display portion 138 to indicate to the user (not shown) various operational conditions and/or the status of various functions of systems 32 and 33 or to present menu options, and may further include input switches 140 to input control data and/or to select from the menu options. Also, the microprocessor 130 provides sufficient computer power and functionality as to allow one control module 72, and one or more interface units 134, to control a plurality of hood exhaust systems 32 in kitchen 12 as will hereinafter be described. Additionally, control module 72 may be utilized to control other typical hood functions such as to turn hood light 142 on and off over cable 144 as indicated by actuation of a light button of switches 140 on interface 134.

Figure 3:
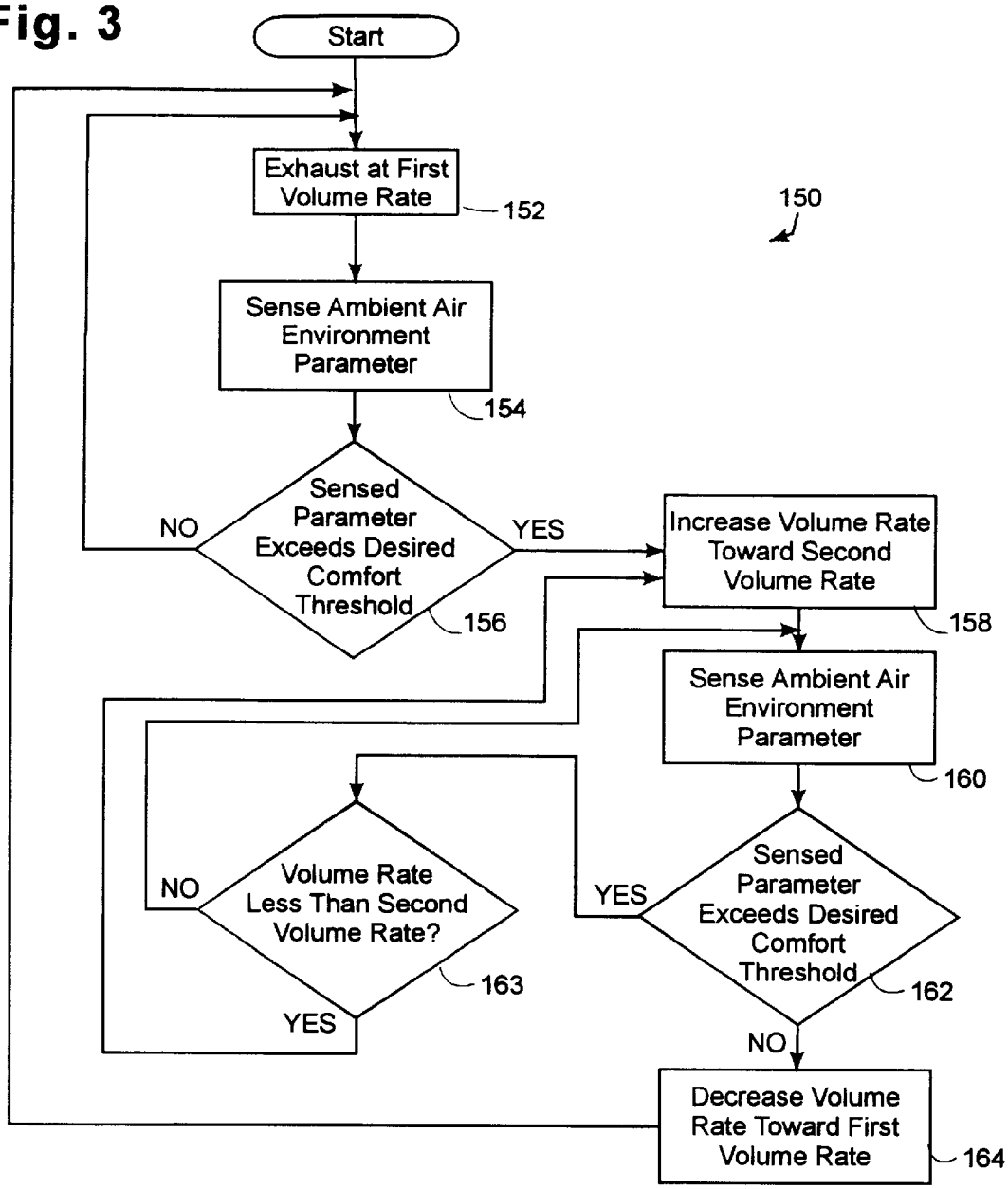
FIG. 3 is a flow diagram of a first embodiment routine utilized in the exhaust system of FIG. 2.

Referring to FIG. 3, a flow diagram is provided showing a first embodiment routine 150 implemented by the control module 72 of FIGS. 1 and 2. Routine 150 varies the exhaust volume rate of air from a first volume rate toward a second volume rate in response to a sensed parameter in the ambient air environment 28 so as to increase air drawn out from the exhaust air environment. To this end, routine 150 begins with the kitchen exhaust system 32 exhausting at a first volume rate (block 152), whereby the first volume rate is either preset, such as a low idle volume rate or is variable based on the activity of the cooking units 18, as discussed above. The first volume rate is less than a second volume rate available to the exhaust system 32, and thus headroom exists to exhaust for purposes other than the direct activity of the cooking units 18. Specifically, the exhaust system 32 may contribute to comfort in the ambient air environment 28.

To this end, in block 154 an ambient air parameter is sensed such as by sensor 94 or sensor 96. If the sensed parameter exceeds a desired comfort threshold (block 156), then the volume rate is increased toward the second volume rate for the purpose of clearing some air from the ambient environment and thereby reducing the level of the sensed parameter. If the desired comfort threshold was not exceeded at block 156, routine 150 returns to block 152 to continue commanding a first volume rate and to continue monitoring the parameter.

If in block 156, the desired comfort threshold was exceeded, the comfort level is increased by first increasing the exhaust volume rate towards a second volume rate (block 158). Then the ambient air environment parameter is sensed (block 160). If the sensed parameter still exceeds the desired comfort threshold (block 162), then a determination is made in block 163 whether the volume rate of system 32 is less than the second volume rate. If less, the processing returns to block 158 to continue increasing volume rate toward the second volume rate. If in block 163 the volume rate is not less than the second volume rate, then processing returns to block 160 to sense the ambient air environment parameter. If, however, in block 162 the sensed parameter no longer exceeds the desired comfort threshold, then the exhaust system 32 is commanded to decrease the volume rate as in block 164 towards a first volume rate and routine 150 loops back to block 152 to repeat the cycle.

Figure 4:
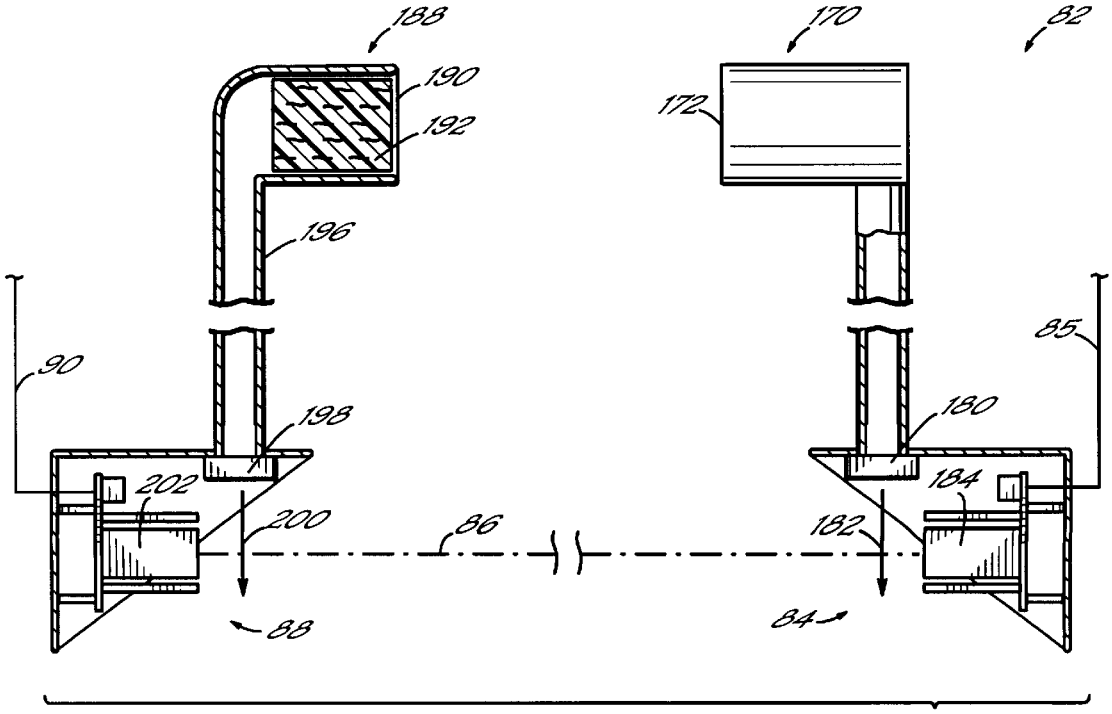
FIG. 4 is a cross-sectional view of the cooking by-product sensor of FIG. 1.

As another aspect of the exhaust system 32, the cooking by-product sensor 70 discussed in FIG. 1 is shown in more detail in FIG. 4. This cross sectional view shows how fouling accumulation is reduced by passing filtered air past the sensitive components of the sensor 82, keeping cooking by-products away. Beginning with the emitter 84, an emitter purge air device 170 includes an intake opening 172 adapted to extend outside of the hood 34. Air is drawn into the emitter purge air device 170 by an electric blower (not shown). Between the electric blower and the intake opening 172 is a cartridge filter (not shown) for filtering out airborne particles. For example, an activated carbon filter can remove a large portion of airborne organic particles to filter the air. The filtered air is then forced through a tubular portion to a clean air admission port 180 and passes along path 182 past the lens 184 of the emitter 84. The tubular portion of the emitter purge air device 170 is long as compared to cross section (i.e., minimum of 2:1 ratio of length to diameter) causing laminar air to flow along path 182, thus reducing cooking by-product drawn to the lens 184 due to turbulence. Similarly, detector purge air device 188 includes an intake opening 190 through which air enters into a cartridge filter 192 through an electric blower (not shown) through a tubular portion 196 out of a clean air admission port 198 along a path 200 past the lens 202 of the detector 88.

Degradation due to fouling accumulation is further mitigated by optics calibration for the cooking by-product sensor 82 by adjusting the intensity of the light beam from the emitter 84 and/or a detection threshold in the detector 88. Thus, the detector 88 should receive a light beam of sufficient intensity during calibration that a decrease in intensity when the light beam encounters cooking by-product will be detectable. This adjustment may compensate for variations in the installed distance between the emitter 76 and detector 88, alignment of the emitter 76 with respect to the detector 88, and performance of the cooking by-product sensor 70. The performance may be degraded by fouling accumulations such as from cooking by-products coming into contact with the lenses 184, 202. Moreover, frequent cleaning of the lenses 184, 202 can lead to abrasions that degrade performance. If the insufficient adjustment remains to further lower the detection threshold in the detector 88 or to increase the intensity of the light beam emitted by the emitter 84 as appropriate calibration fails, then the cooking by-product sensor 82.

Additionally, the cooking by-product sensor 82 may utilize a coherent light beam from a laser for emitter 84 to advantageously span greater distances than a noncoherent light beam since more intensity is maintained along path 86 so as to be used in wider hoods 34 then previously possible with an infrared beam, for example. This greater intensity of a coherent light beam may also be advantageous in calibrating in the presence of fouling accumulation since sufficient intensity may pass through to be able to detect cooking by-product. Whether coherent or noncoherent, utilizing a visible light beam may be advantageously employed to simplify alignment of the emitter 84 with respect to the detector 88.

Figure 5:
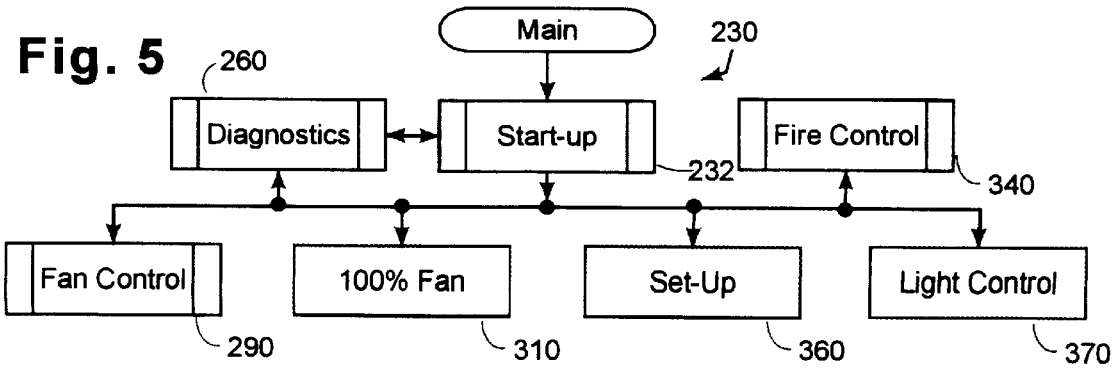
FIG. 5 is a top-level block diagram of a more detailed second embodiment of an interrupt-driven routine utilized in the exhaust system of FIG. 2.

Referring to FIG. 5, a top-level block diagram is shown for an interrupt-driven, more detailed second embodiment main routine 230, implemented on the control module 72 of FIG. 2. A plurality of functions are provided, taking advantage of available sensed parameters to coordinate use of the exhaust system 32.

Upon application of power to the control module 72, main routine 230 begins with a start-up routine 232 to ensure that exhaust system 32 is in a desirable state, such as the fan 50 either appropriately on or off, as will be discussed below in FIG. 6. During start-up routine 232, determination of the desirable state depends in part on whether the exhaust system is working properly. Thus a diagnostic routine 260 is shown in FIG. 5 as operating in partnership with the start-up routine 232. Diagnostics routine 260 runs periodically or continuously without user interaction, and will be discussed in more detail below in FIG. 7.

A fan control routine 290 provides for control of the volume rate of exhaust system 32, unless preempted by a fault detected by the diagnostic routine 260 or by other overrides such as the 100% fan routine 310, whereby a user may press 100% fan button 140 to command the control module 72 to output a maximum fan speed signal. The fan control routine 290 will be discussed below in more detail in FIGS. 8 and 9.

A fire control routine 340 is advantageously provided, also operating periodically or continuously without user interaction, and will be discussed in more detail below in FIG. 10. Taking advantage of flexibility of the control module 72, a set-up routine 360 is provided for such functions as configuring the system for the appropriate sensors and for selecting thresholds, for example, as discussed above. Also provided is a light control routine 370 to turn on and off the light 142 as discussed above.

Figure 6:
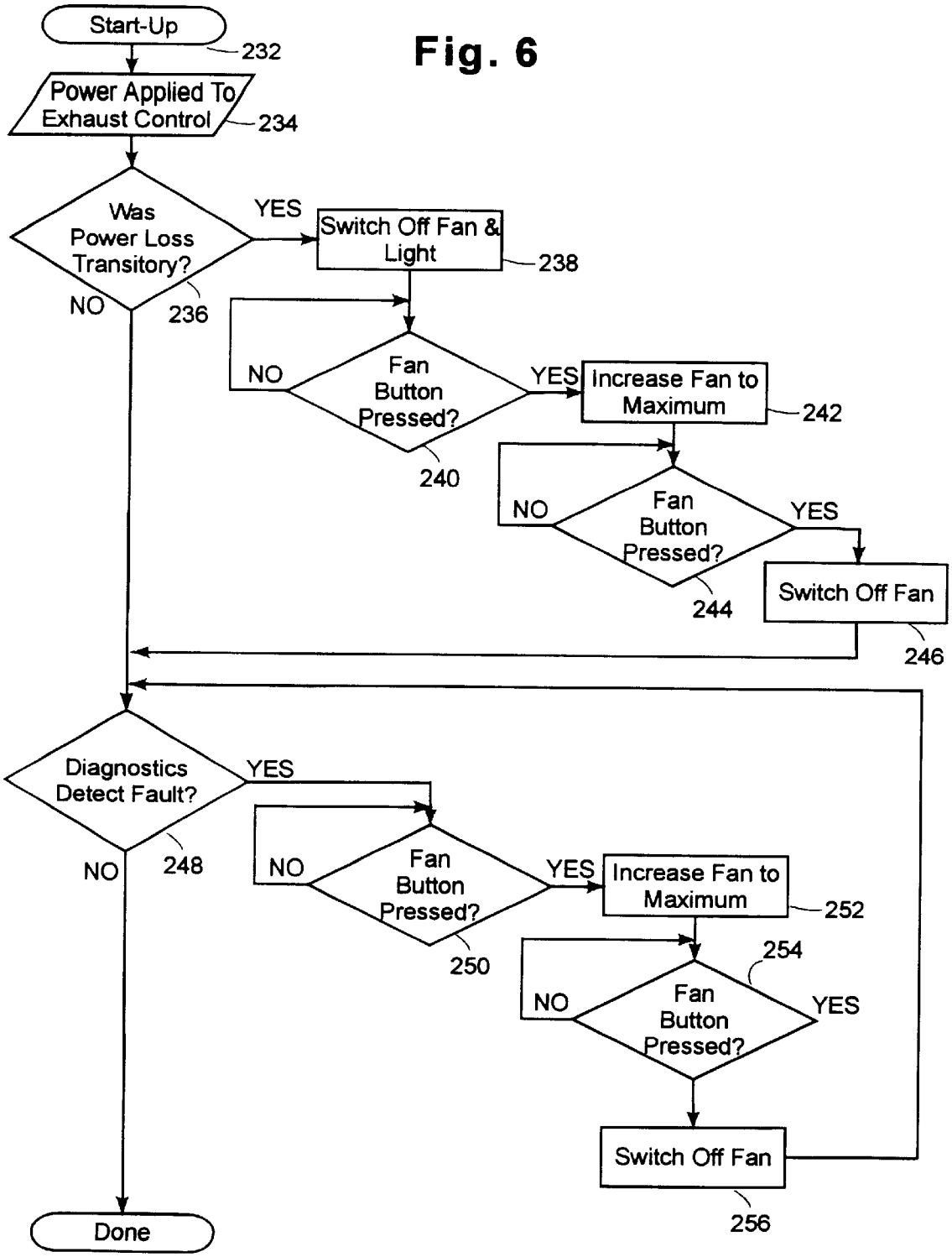
FIG. 6 is the flow diagram of a start-up routine referenced in the top-level block diagram of FIG. 5.

Referring to FIG. 6, the start-up routine 232, referenced in FIG. 5, provides for the appropriate fan setting, ether on or off after power is applied to the control module 72. This appropriate setting depends upon whether the disruption in power to the control module 72 was transitory and whether the diagnostics routine has detected a fault, as will be discussed.

Determining whether power has been disrupted from a transitory period allows for the exhaust system 32 to handle minor power fluctuations without user interaction. For example, a brief spike in electrical demand within the facility 10 could drive down voltage levels provided to the control module 72, below the level required by the microprocessor 130. Allowing the exhaust system 32 to remain shut off would be inconvenient, especially if the cooking units 18 are currently generating cooking heat and cooking by-products. However, a safety consideration exists to warrant shutting-down the fan 50 if the disruption is longer than transitory, such as greater than 10 seconds, because personnel could be injured when the exhaust system 32 resumes exhausting after power is reapplied. For example, maintenance personnel could come into contact with the fan 50.

Start-up routine 232 begins by an event 234 of power being applied to the control module 72. Then, a determination is made as to whether the power loss was transitory (block 236), for example, the memory 132 may have a nonvolatile portion within which a time stamp is periodically recorded such that an excess period such as 10 seconds between recorded time stamps is detectable. Alternatively, the control module comes include other implementations, such as a capacitor (not shown) that discharges at a known rate when power is removed from the control module 72 with a threshold voltage for the capacitor below which a power interruption is determined to be longer than transitory.

If in block 236, the power loss was longer than transitory, then user interaction is required to resume exhausting. First, the fan 50 and light 142 are switched off for safety and to alert personnel (block 238). Then start-up routine 232 waits for fan button 140 to be pressed. Thus block 240 testing for fan button 140 having been pressed repeats until true, and then the fan 50 is commanded to increase to maximum (block 242). Then routine repeatedly tests at block 244 for fan button 140 to be pressed again, and when true, switches off the fan 50 (block 246). Thus, the disruption in power has been handled by routine 232 and processing proceeds to block 248, either after determining that the power loss was transitory in block 236 or after switching off the fan 50 in block 246. The remaining portion of the start-up routine 32 handles the situation where a fault is detectable by the control module 72.

Thus, block 248 determines whether diagnostics routine 260 has detected a fault and thus start-up routine 232 does not proceed until diagnostics routine 260 has made this determination. If a fault was determined to have been detected by the diagnostic routine 260 in block 248, then a degraded mode of operation is appropriate. Although fan control routine 290 may be deemed thus unavailable due to the fault, start-up routine 232 allows for the user to select either switching the fan 50 on to maximum or off so that safe operation of the cooking units 18 can continue until the fault is repaired. To this end, after block 248 determines that a fault exists, the routine 232 waits for the fan button 140 to be pressed in block 250. When pressed in block 250, then the fan 50 is increased to maximum (block 252). Then routine 232 waits for the fan button 140 to be pressed again (block 254) before switching off the fan 50. Operation of the exhaust system in the degraded mode may be continued, going between off and maximum as shown by block 256 looping back to block 248 to determine anew whether the diagnostics routine 260 detects a fault. If no fault was detected in block 248, then start-up routine 232 is done and the other functions referred to in FIG. 5 may commence.

Figure 7:
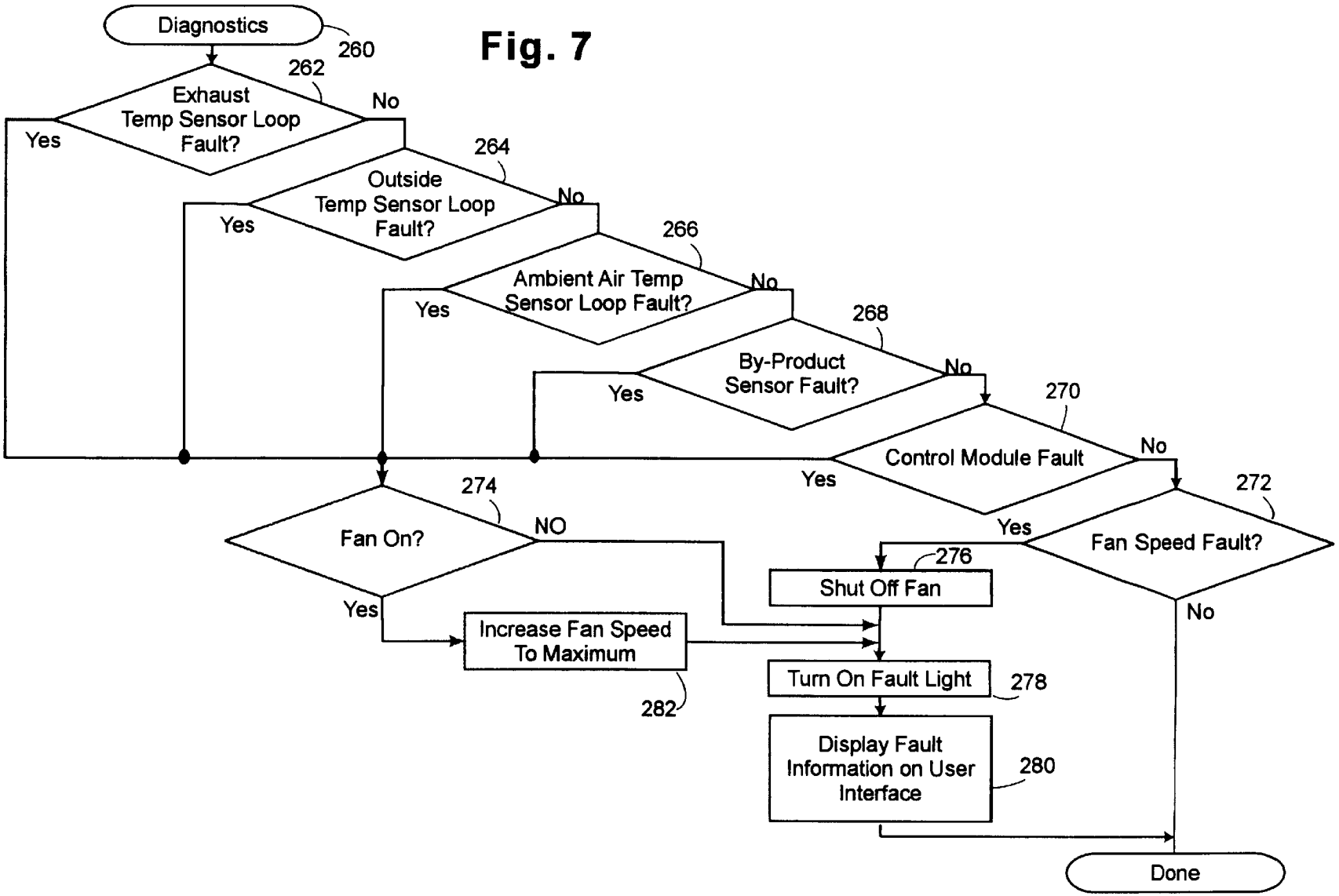
FIG. 7 is the flow diagram of a diagnostics routine referenced in the top-level block diagram of FIG. 5.

Referring to FIG. 7, the diagnostics routine 260, referenced in FIGS. 5 and 6, operates periodically or continuously to detect faults in the exhaust system 32, affecting appropriate control of the fan 50. Most faults detected are deemed to affect determining the appropriate volume rate, and thus the fan 50 is increased to maximum to prevent unsafe underexhausting of cooking heat and/or cooking by-products. Faults deemed to affect safe operation of the fan 50, such as detected malfunction of the motor 50 or motor speeds controller 70, warrant shutting off the fan 50. Diagnostics routine 260 also alerts personnel to the fault.

Thus, a series of fault tests are shown wherein successfully passing one results in moving to the next. In block 262, exhaust temperature sensor loop comprised of sensor 76 and cable 78 is tested for fault. If none, then in block 264, the outside temperature sensor loop comprised of sensor 102 and cable 104 is tested for a fault. If none, then in block 266 the ambient air temperature sensor loop comprised of the ambient air temperature sensor 94 and cable 98 is tested for a fault. If none, then in block 268, the cooking by-product sensor 82 is tested for a fault. If none, then in block 270, the control module 72 is tested for an internal fault. If none, then in block 272, the fan speed signal returned from the motor speed controller 70 is tested for a fault. If none, then diagnostic routine 260 is done. If, in block 272 the fan speed is detected as a fault, then the fan is shut off (block 276) since continued operation is deemed unsafe. Then personnel are alerted about the cause of the shut down by turning on fault light 138 (block 278) and displaying the type of fault on display portion 138 (block 280). Then routine 260 is done.

Returning to blocks 262–270, if any of these tests do detect a fault, then diagnostics routine 260 proceeds to block 274 wherein a determination is made as to whether the fan is on. If it is on in block 274, then the fan 50 is increased to maximum to prevent underexhausting and processing proceeds to block 278 to alert personnel. If in block 274 the fan is determined to be off, then the fan the routine proceeds to 282 where is left off and processing proceeds to block 278 to alert personnel.

Although a sequential listing of tests is depicted in FIG. 7, it should be appreciated that such tests could occur is various orders, both serially or in parallel. Moreover, certain portions of the exhaust system 32 may or may not have the capability for diagnostics.

Figure 8:
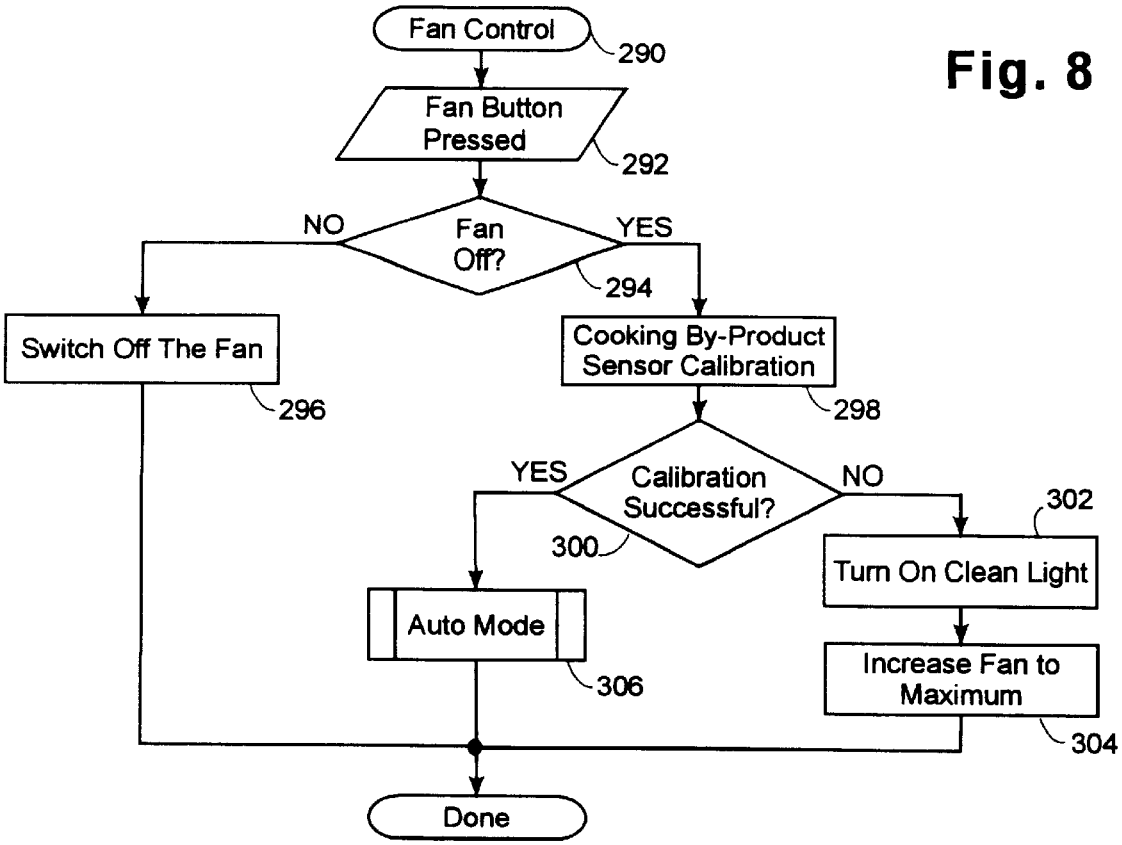
FIG. 8 is the flow diagram of a fan control routine referenced in the top-level block diagram of FIG. 5.

Referring to FIG. 8, the fan control routine 290 referenced in FIG. 5 is depicted as providing control of the fan 50 in the absence the overrunning control by the start-up routine 230, diagnostic routine 260, or 100% fan routine 310, as discussed above. Fan control routine 290 depends on user selection as shown by the fan button 140 being pressed event in block 292. Then in block 294, a determination is made as to whether the fan 50 is off. If the fan 50 is not off, then the fan is switched off at block 296 and fan control routine 290 is done.

If in block 294, the fan 50 is determined to be off, then the fan 50 is to be turned on. However, the cooking by-product sensor 82, should be calibrated first (block 298), as discussed above. Performing calibration at this time is appropriate since the exhaust system typically is turned on before the cooking units 18 generate cooking by-products, if calibration is not deemed successful in block 300, then cooking by-product sensor 82 is probably fouled by accumulated cooking by-product, and therefore the clean light 138 on user interface 134 is turned on to alert personnel (block 302) and the fan 50 is increased to maximum (block 304). Then fan control routine 290 is done. If calibration is successful back in block 300, then fan control routine 290 goes into auto mode routine 306, as will be discussed below in FIG. 9.

Figure 9:
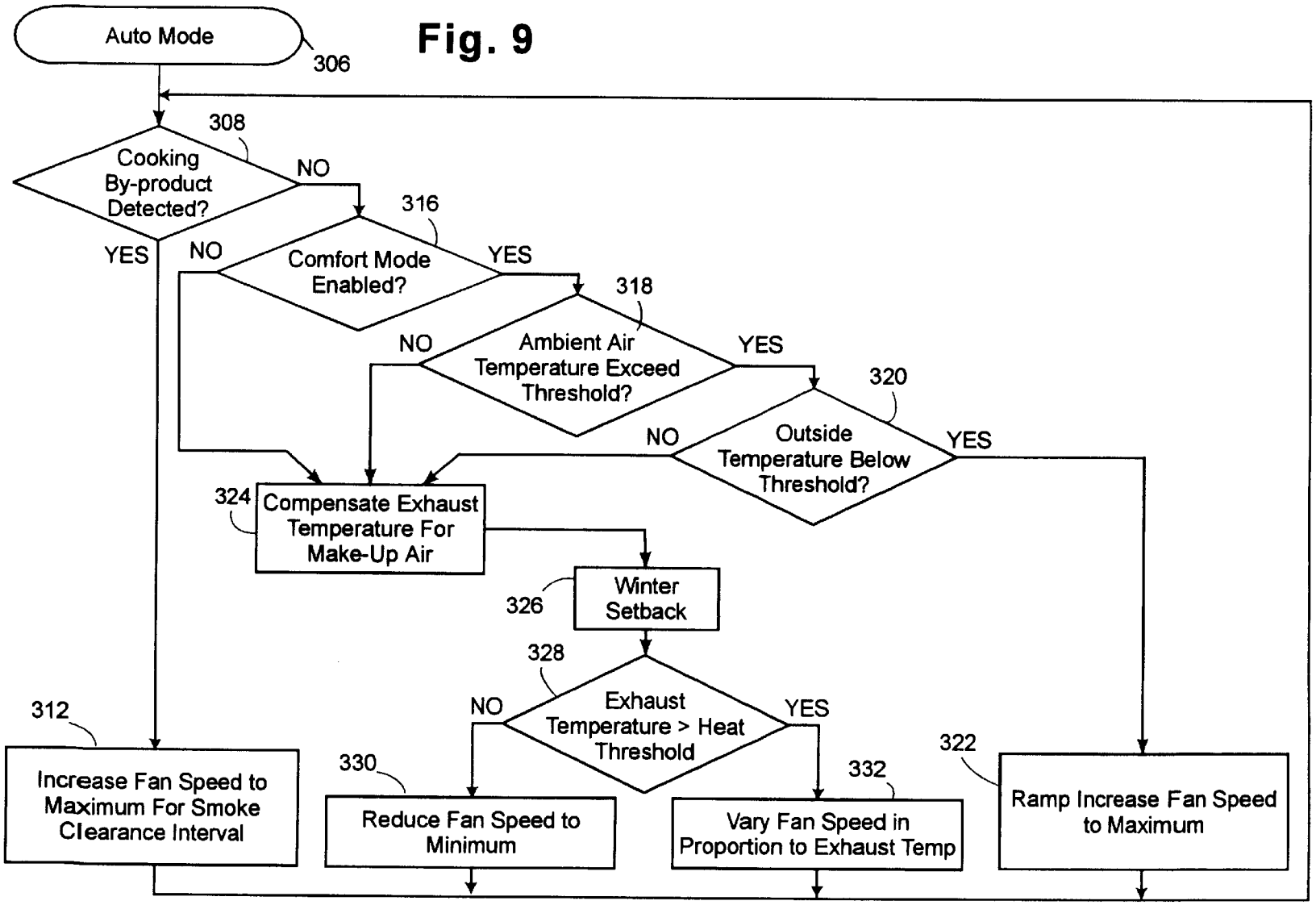
FIG. 9 is the flow diagram of an auto mode referenced in the fan control routine in FIG. 8.

Referring to FIG. 9, the auto mode routine 306 referenced in FIG. 8 is provided to vary the volume rate to accommodate desired changes for comfort in the ambient air environment 28, while otherwise appropriately exhausted at a first volume rate correlating to activity of the cooking units 18. Beginning at block 308, a determination is made as to whether cooking by-products are detected by cooking by-products sensor 82. If detected, then the fan 50 is increased to maximum for a smoke clearance interval, or "hang time", such as 30 to 90 seconds (block 312). Hang time is advantageous since the path of cooking by-products in the air flow path 52 may be intermittently detected. Rapidly cycling the fan speed without hang-time would be annoying to personnel, potentially damaging to the exhaust system 32, and/or may allow cooking by-product to escape into the ambient air environment 28. Although the fan 50 is increased to maximum in block 312, it should be appreciated that confidence in the ability to detect and exhaust cooking by-products may allow varying the speed of fan 50 to a volume rate other than maximum. After block 312 is complete, processing returns to block 308 to reevaluate the appropriate volume rate for the exhaust system 32.

Returning to block 312, if cooking by-product is not detected, then auto mode routine 306 determines whether exhausting for comfort or safety is appropriate by finding if three conditions are satisfied in blocks 316, 318, and 320.

First, in block 316, a determination is made as to whether comfort mode is enabled since auto mode advantageously accommodates disabling comfort mode. If enabled, then in block 318, a determination is made as to whether the ambient air temperature exceeds a desired comfort threshold. If exceeded, then in block 320 a determination is made as to whether outside temperature is below a desired comfort threshold. If below, then in block 322 speed of the fan 50 is ramp increased to maximum over a period such as one minute. The ramping advantageously reduces annoying rapid sound changes from the exhaust system 32. Then auto mode routine 306 repeats by returning to block 308 so that changes in any of the conditions tested in blocks 308, 316, 318 and/or 320 can cause the auto mode routine to change to an appropriate volume rate.

Returning to blocks 316, 318, 320 wherein conditions were tested for entering into comfort mode, if any of the three were not satisfied, then processing proceeds to block 324. Since exhausting for comfort and/or for cooking by-products is not warranted.

Thus, the remaining portion of auto mode routine 306 provides for exhausting a volume rate to the amount of cooking heat generated by the cooking units 18, as described above. Advantageously, this portion begins at block 324 by providing for compensating the sensed exhaust temperature for make-up air temperature. Thereafter, winter setback is advantageously performed (block 326). Then a determination is made as to whether the exhaust temperature exceeds a desired comfort threshold (block 328). If not exceeded, then the speed of fan 50 is reduced to a minimum (block 330), else the speed of fan 50 is varied at a volume rate in proportion to exhaust temperature (block 332). After both blocks 330 and 332, processing returns to block 308 so that auto mode routine 306 can change mode of operation if the conditions change in blocks 308, 316, 318 and/or 320.

Figure 10:
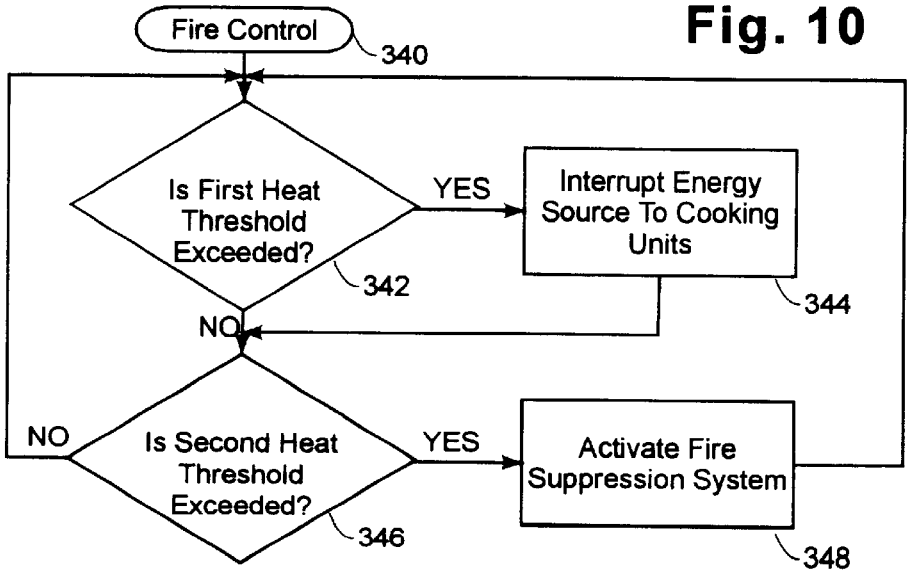
FIG. 10 is the flow diagram of a fire control routine referenced in the top-level block diagram of FIG. 5.

Referring to FIG. 10, the fire control routine 340 is advantageously used by periodically or continuously monitoring exhaust temperature for an elevated temperature requiring fire control. Thus, in block 342 a determination is made as to whether a first heat threshold is exceeded. If exceeded, then the energy source 110 is interrupted to the cooking units 18. If not exceeded in block 342 or after block 344, processing proceeds to block 346 to make a determination as to whether a second threshold is exceeded. If exceeded, then fire suppression system 120 is activated (block 348). If not exceeded in block 346 or after block 348, routine 340 repeats.

Figure 11:
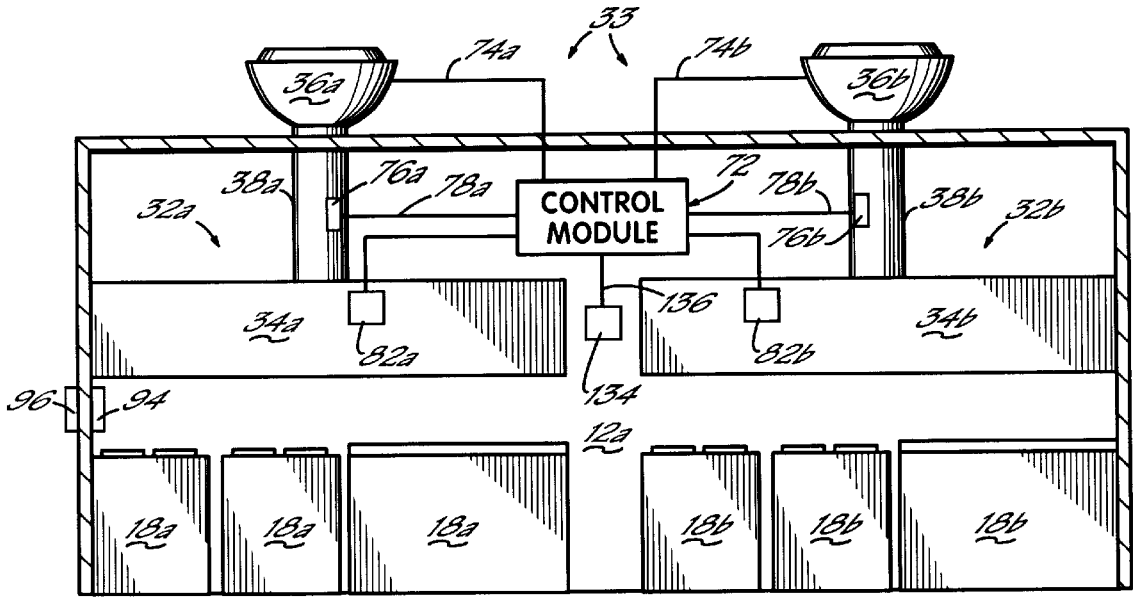
FIG. 11 is a block diagram of a multiple hood exhaust system in accordance with the principles of the present invention.

Referring to FIG. 11, a kitchen 12*a* having a plurality of exhaust systems 32*a*, 32*b* is shown as a third embodiment, advantageously utilizing the microprocessor-architecture of control module 72 to provide for simplified user control and/or coordinated volume rate control for comfort in the ambient air environment 28. Simplified user control is illustrated by a single user interface 134 connected by cable 136 to control module 72. The functions of air control system 33 for a single exhaust system 32 as described in FIGS. 1–10 may be expanded to the plurality of exhaust systems 32*a*, 32*b*, as will now be described.

Coordinated volume rate control may be advantageously accomplished by the shared control module 72 for exhausting for comfort in the ambient air environment 28. For example, cooking units 18*a* may be idle, generating no cooking by-products. If on, cooking units 18*a* may be generating a low amount of cooking heat in a hood 34*a* of exhaust system 32*a*. Thus an exhaust temperature sensor 76*a* in the duct 38*a* may register a first exhaust temperature below a desired comfort threshold. The control module 72, receiving the sensed first exhaust temperature via cable 78*a* from sensor 76*a* would then command a minimum fan speed signal 74*a* to fan assembly 36*a*.

Simultaneously, cooking units 18*b* under hood 34*b* are actively producing a large quantity of cooking heat and cooking by-products. This activity is sensed by sensor 76*b* in duct 38*b*. This second sensed exhaust temperature is relayed from sensor 76*b* to the control module 72 by cable 78*b*. Thus prompted, the control module 72 commands a maximum fan speed signal 74*b* to fan assembly 36*b*. Thus each exhaust system 32*a*, 32*b*, is being utilized at different volume rates appropriate to the activity of their respective cooking units 18*a*, 18*b*.

Coordinated use becomes advantageous when ambient air sensor 94 senses a parameter exceeding a threshold that is then relayed to control module 72. Control module 72 can then utilize available first exhaust system 32*a* for comfort while maintaining second exhaust system 32*b* in another mode. It would be appreciated that other functions such as exhausting for carbon dioxide or shutting down an exhaust system 32*a*, 32*b* for detected fire would be allowed by the third embodiment.

In use, an exhaust system 32 for a commercial kitchen 12 exhausts air at first volume rate which is either preset or varies in proportion to cooking heat and/or cooking by-product generated by the cooking units 18. Thereafter, in response to a sensed parameter of the ambient air environment 28 such as temperature and/or gas level exceeding a desired comfort threshold, increasing the volume rate of exhausting air toward a second volume rate, the second volume rate being above the first volume rate, whereby to decrease the sensed parameter toward normal by increasing air drawn out of the ambient air environment 28 through the hood 34. Once the sensed parameter returns to normal, the exhaust system 32 decreases toward the first volume rate.

By virtue of the foregoing, there is thus provided an exhaust system 32 and method which improves the comfort or enhances the safety of the kitchen 12 or other parts of the facility 10, such as by selectively increasing the volume rate of air being exhausted in response to conditions in the ambient air environment 28 becoming uncomfortable and/or unsafe. The exhaust system 32 and method of the present invention also provides a wider range of flexibility in the management of the environment of the kitchen 12.

While the present invention has been illustrated by description of several embodiments and while the illustrative embodiments have been described in considerable detail, it is not the intention of applicants to restrict or in any way limit the scope of the appended claims to such detail. Additional advantages and modifications readily appear to those skilled in the art.

For example, the air control system 33 may be in the form of a kit to allow retrofitting existing kitchen exhaust systems. To this end, an air control system 33 could include the sensors and electrical cables described herein, and the control module 72, but will typically at least include an ambient air environment sensor (94 or 96) and a control mechanism such as control module 72 and/or controller 70. Moreover, in some embodiments, although the control module 72 may be configured to operate additional devices such as for fire safety, or make-up air, these items need not be present, with the control module 72 differentiating between an item deemed to have failed versus one that is not installed.

The method described herein, for increasing kitchen comfort by increasing the volume rate of exhaust when the kitchen ambient air environment temperature is too warm need not be subject to the temperature of outside environment 26. Alternatively, a temperature differential may be required before the volume rate increase is permitted. For example, a kitchen ambient air environment temperature of 76° F. and an outside environment temperature of 74° F. may provide too small of a differential to warrant the noise and power consumption of utilizing the exhaust system. Also, the ambient air environment temperature sensor 94 may be placed in other parts of the facility 10, such as in the dining room 14. For fire control, when the first heat threshold is exceeded, an alarm (not shown) could be sounded and coupling element 112 manually actuated to interrupt the energy source 110 to cooking units 18.

An exhaust system 32 may vary the volume rate of air exhausted in a number of ways other than by varying the speed of motor 50 as described herein. For example, the variability of the fan motor 50 may be to a plurality of discrete settings, such as a two-speed fan. Also, a plurality of fans within a hood system may be used, with a subset of the fans being activated to achieve lower volume rates of air exhausted. Further, dampers or other restrictions could be used to modulate the air flow volume rate. The invention in its broader aspects is therefore not limited to the specific details, representative apparatus and methods, and illustrative examples shown and described. Accordingly, departure may be made from such details without departing from the spirit or scope of applicants' general inventive concept.

What is claimed is:

1. In a kitchen forming part of a facility and having a cooking unit adapted to generate heat and cooking by-product and a hood over the cooking unit adapted to exhaust air at a plurality of volume rates from inside the kitchen to outside the facility along an air flow path defined between the cooking unit to outside the facility through the hood, the facility having an ambient air environment outside of the hood and spaced away from the air flow path, a method of varying the ambient air environment comprising:

exhausting air along the air flow path at a first volume rate such that air is drawn out of the ambient air environment through the hood;

thereafter, in response to a parameter of the ambient air environment exceeding a desired comfort threshold when the first volume rate is below a second, greater volume rate, increasing the volume rate of exhausting air along the air flow path toward the second volume rate whereby to increase air drawn out of the ambient air environment through the hood; and sensing an environmental parameter correlated to temperature outside the facility and, responsive thereto, selectively maintaining the first volume rate irrespective of the ambient air environment parameter.

2. The method of claim 1 wherein the parameter of the ambient air environment is temperature, the method further comprising sensing the ambient air environment temperature such that the volume rate is increased toward the second volume rate in response to the temperature of the ambient air environment exceeding a desired comfort threshold temperature.

3. The method of claim 2 further comprising sensing the ambient air environment temperature within the kitchen.

4. The method of claim 2 including increasing toward the second volume rate in response to the temperature of the ambient air environment exceeding about 75° F.

5. The method of claim 2 further comprising maintaining the first volume rate of air exhaust irrespective of the ambient air environment temperature in response to the sensed temperature being above a selected temperature.

6. The method of claim 5 wherein the selected temperature is about 75° F., the method including increasing toward the second volume rate in response to the temperature of the ambient air environment exceeding about 75° F. unless the sensed temperature is above about 75° F. in which event the first volume rate of air exhaust is maintained irrespective of the ambient air environment temperature.

7. The method of claim 2 further comprising rampingly increasing from the first volume rate toward the second volume rate.

8. The method of claim 2 further comprising decreasing back toward the first volume rate in response to the temperature of the ambient air environment no longer exceeding the desired comfort threshold temperature.

9. The method of claim 8 further comprising rampingly decreasing toward the first volume rate.

10. The method of claim 1 wherein the parameter is gas level, the method further comprising sensing the ambient air environment gas level and increasing toward the second volume rate in response to the gas level of the ambient air environment exceeding a desired comfort threshold gas level.

11. The method of claim 10 further comprising sensing the ambient air environment gas level outside of the kitchen.

12. The method of claim 10 including increasing toward the second volume rate in response to the gas level of the ambient air environment exceeding about 100 ppm $CO_2$.

13. The method of claim 1 further comprising selecting the second volume rate to be a maximum volume rate for which the hood is adapted to exhaust air.

14. The method of claim 1 further comprising increasing to the second volume rate.

15. The method of claim 1 further comprising rampingly increasing from the first volume rate toward the second volume rate.

16. The method of claim 1 further comprising decreasing toward the first volume rate in response to the parameter of the ambient air environment no longer exceeding the desired comfort threshold.

17. The method of claim 16 further comprising rampingly decreasing toward the first volume rate.

18. The method of claim 1 further comprising increasing to the second volume rate in response to detection of cooking by-products irrespective of the parameter of the ambient air environment.

19. The method of claim 1 further comprising sensing a heat level in the air path and establishing the first volume rate in correlation to the sensed heat level whereby the first volume rate is variable.

20. The method of claim 19 further comprising sensing a gas level in the ambient air environment and establishing the first volume also in correlation to the sensed gas level.

21. The method of claim 19 further comprising establishing a minimum volume rate and establishing a minimum general heat level below which the first volume rate will be at the minimum volume rate, the method further comprising sensing temperature correlated to outside the facility and increasing the minimum second heat level to a higher level if the sensed outside temperature is below a selected temperature.

22. The method of claim 19 further comprising establishing a minimum volume rate and establishing a minimum sensed heat level below which the first volume rate will be at the minimum rate, the method further comprising sensing temperature correlated to outside the facility and decreasing the minimum volume rate to a lower minimum rate if the sensed outside temperature is below a selected temperature.

23. The method of claim 19 wherein the cooking unit is energized from an energy source, the method comprising interrupting the energy source to the cooking unit in response to the sensed heat level exceeding a first heat threshold.

24. The method of claim 23 wherein the kitchen includes a fire suppression system, the method further including activating the fire suppression system in response to the sensed heat level exceeding a second heat threshold.

25. The method of claim 24 wherein the second heat threshold is higher than the first heat threshold.

26. The method of claim 24 wherein the second heat threshold is defined by the sensed heat level exceeding the first heat threshold for a predetermined duration.

27. The method of claim 19 wherein sensing the heat level includes sensing temperature in the air flow path.

28. In a kitchen forming part of a facility and having a cooking unit adapted to generate heat and cooking by-product and a hood over the cooking unit adapted to exhaust air at a plurality of volume rates from inside the kitchen to outside the facility along an air flow path defined between the cooking unit to outside the facility through the hood, the facility having an ambient air environment outside of the hood and spaced away from the air flow path, a method of varying the ambient air environment comprising:

sensing a gas level in the ambient air environment;

establishing a first volume rate correlated to at least the sensed gas level whereby the first volume rate is variable;

exhausting air along the air flow path at the first volume rate such that air is drawn out of the ambient air environment through the hood; and thereafter, in response to a temperature parameter of the ambient air environment exceeding a desired comfort threshold temperature when the first volume rate is below a second, greater volume rate, increasing the volume rate of exhausting air along the air flow path toward the second volume rate whereby to increase air drawn out of the ambient air environment through the hood.

29. The method of claim 28 further comprising increasing the volume rate to the second volume rate.

30. In a kitchen forming part of a facility and having a cooking unit adapted to generate heat and cooking by-product and a hood over the cooking unit adapted to exhaust air at a plurality of volume rates from inside the kitchen to outside the facility along an air flow path defined between the cooking unit to outside the facility through the hood, the facility having an ambient air environment outside of the hood and spaced away from the air flow path, a method of varying the ambient air environment comprising:

sensing at least one of a heat level in the air path and cooking by-product generated by the cooking unit;

exhausting air along the air flow path at a variable volume rate correlated to at least one of the sensed heat and the cooking by-product such that air is drawn out of the ambient air environment through the hood;

thereafter, in response to a parameter of the ambient air environment exceeding a desired comfort threshold when the variable volume rate is below a second, greater volume rate, increasing the volume rate of exhausting air along the air flow path toward the second volume rate whereby to increase air drawn out of the ambient air environment through the hood; and thereafter, decreasing the volume rate of air exhausting along the air flow path toward the first volume rate in response to the parameter of the ambient air environment no longer exceeding the desired comfort threshold.

31. The method of claim 30 further comprising increasing the volume rate to the second volume rate.

32. The method of claim 30 further comprising sensing both the heat level in the air path and cooking by-product generated by the cooking unit and exhausting air along the air flow path at a variable volume rate correlated to both the sensed heat and the cooking by-product.

33. In a kitchen having a cooking unit adapted to generate heat and cooking by-product and a hood over the cooking unit adapted to exhaust air from inside the kitchen to outside the facility along an air flow path defined between the cooking unit to outside the facility through the hood, the cooking unit being energized from an energy source, a method of fire control comprising:

exhausting air along the air flow path;

sensing a heat level in the air flow path; and in response to the sensed heat level in the air flow path exceeding a first heat threshold greater than normal cooking heat levels and less than a heat level indicative of fire, interrupting the energy source to the cooking unit.

34. The method of claim 33 wherein the kitchen includes a fire suppression system, the method further including activating the fire suppression system in response to the sensed heat level exceeding a second heat threshold.

35. The method of claim 34 wherein the second heat threshold is higher than the first heat threshold.

36. The method of claim 34 wherein the second heat threshold is defined by the sensed heat level exceeding the first heat threshold for a predetermined duration.

37. The method of claim 33 wherein sensing the heat level includes sensing temperature in the air flow path.

38. The method of claim 33 wherein the energy source is gas and the cooking unit is coupled to the energy source via a valve in an open state, the method including interrupting the energy source to the cooking unit by closing the valve.

39. The method of claim 33 wherein the energy source is electric and the cooking unit is coupled to the energy source via a relay in a closed open state, the method including interrupting the energy source to the cooking unit by opening the relay.

40. In a kitchen forming part of a facility and having a cooking unit adapted to generate heat and cooking by-product and a hood over the cooking unit adapted to exhaust air at a plurality of volume rates from inside the kitchen to outside the facility along an air flow path defined between the cooking unit to outside the facility through the hood, a method of varying the volume rate of air exhaust comprising:

sensing a heat level in the air flow path;

sensing a temperature correlated to outside the facility;

when the sensed outside temperature is above a selected temperature, exhausting air along the air flow path at a volume rate correlated to the sensed heat level only when the sensed heat level is above a first threshold; and when the sensed outside temperature is below the selected temperature, exhausting air along the air flow path at a volume rate correlated to the sensed heat level when the sensed heat level is above a second, higher threshold.

41. In a kitchen forming part of a facility and having a cooking unit adapted to generate heat and cooking by-product and a hood over the cooking unit adapted to exhaust air at a plurality of volume rates from inside the kitchen to outside the facility along an air flow path defined between the cooking unit to outside the facility through the hood, a method of varying the volume rate of air exhaust comprising:

sensing a heat level in the air flow path;

sensing a temperature correlated to outside the facility;

when the sensed outside temperature is above a selected temperature, exhausting air along the air flow path at a volume rate between a first minimum volume rate and a maximum volume rate correlated to the sensed heat level; and when the sensed outside temperature is below the selected temperature, exhausting air along the air flow path at a volume rate between a second minimum volume rate and the maximum volume rate correlated to the sensed heat level, the second minimum volume rate being lower than the first minimum volume rate.

42. An air control system for a kitchen forming part of a facility, the kitchen having a cooking unit adapted to generate heat and cooking by-product and a hood over the cooking unit, the air control system comprising:

an exhaust system associated with the hood and adapted to exhaust air at a plurality of volume rates from inside the kitchen to outside the facility along an air flow path defined between the cooking unit to outside the facility through the hood;

an ambient air environment sensor adapted to sense a parameter of an ambient air environment defined outside the hood and spaced away form the air flow path, the ambient air environment sensor being operatively coupled to the exhaust system such that the volume rate of air exhausted thereby is responsive, at least in part, to the parameter of the ambient air environment sensed by the ambient air environment sensor; and an outside sensor adapted to sense an environmental parameter correlated to temperature outside of the facility and being operatively coupled to the exhaust system so as to prevent air from being exhausted at a volume rate responsive to the parameter of the ambient air environment sensed by the ambient air environment sensor.

43. The air control system of claim 42 further comprising a heat sensor adapted to sense cooking heat level in the air flow path and operatively coupled to the exhaust system such that the volume rate of air exhausted thereby is further responsive, at least in part, to the cooking heat level sensed by the heat sensor.

44. The air control system of claim 43 further comprising a fire controller responsive to the heat sensor.

45. The air control system of claim 42 further comprising a by-product sensor adapted to sense cooking by-product level in the air flow path and operatively coupled to the exhaust system such that the volume rate of air exhausted thereby is further responsive, at least in part, to the cooking by-product level sensed by the by-product sensor.

46. The air control system of claim 42, the exhaust system including a motor and a motor controller, the motor controller operative to vary the motor speed.

47. The air control system of claim 42, the exhaust system including an exhaust assembly adapted to exhaust air at the plurality of volume rates and a control module operative to control the exhaust assembly, the control module being responsive to the ambient air environment sensor.

48. The air control system of claim 42 wherein the ambient air environment parameter sensor includes a temperature sensor.

49. An air control system for a kitchen forming part of a facility, the kitchen having a cooking unit adapted to generate heat and cooking by-product and a hood over the cooking unit, the air control system comprising:

an exhaust system associated with the hood and adapted to exhaust air at a plurality of volume rates from inside the kitchen to outside the facility along an air flow path defined between the cooking unit to outside the facility through the hood; and an ambient air environment sensor adapted to sense a parameter of an ambient air environment defined outside the hood and spaced away form the air flow path, wherein the ambient air environment parameter sensor includes a gas sensor, the ambient air environment sensor being operatively coupled to the exhaust system such that the volume rate of air exhausted thereby is responsive, at least in part, to the parameter of the ambient air environment sensed by the ambient air environment sensor.

50. The air control system of claim 49 wherein the gas sensor is a $CO_2$ sensor.

51. An air control system for an exhaust system of a kitchen forming part of a facility, the kitchen having a cooking unit adapted to generate heat and cooking by-product, a hood over the cooking unit, and an exhaust system associated with the hood and adapted to exhaust air from inside the kitchen to outside the facility along an air flow path defined between the cooking unit to outside the facility through the hood, the facility having an ambient air environment defined outside the hood and spaced away from the air flow path and having at least one parameter characteristic of the ambient air environment, the air control system comprising:

an ambient air environment sensor a dapted to sense said parameter of said ambient air environment;

a control mechanism adapted to be operatively coupled to said exhaust system and the ambient air environment sensor to cause air to be exhausted along said air flow path at a volume rate responsive, at least in part, to said parameter of said ambient air environment sensed by the ambient air environment sensor; and an outside sensor adapted to sense an environmental parameter correlated to temperature outside of said facility and to be operatively coupled to said exhaust system so as to prevent air from being caused to be exhausted along said air flow path at a volume rate responsive to said parameter of said ambient air environment.

52. The air control system of claim 51 wherein said exhaust system includes an exhaust assembly for exhausting air, the air control system including a controller adapted to be operatively associated with said exhaust assembly and being responsive to the control mechanism such that the controller causes the exhaust assembly to exhaust air at the volume rate in response to the control mechanism.

53. The air control system of claim 51 further comprising a heat sensor adapted to sense cooking heat level in said air flow path, the control mechanism being further adapted to be operatively coupled to the heat sensor to cause air to be exhausted along said air flow path at a volume rate responsive, at least in part, to said cooking heat level sensed by the heat sensor.

54. The air control system of claim 53 further comprising a fire controller responsive to the heat sensor.

55. An air control system for a kitchen having a cooking unit adapted to generate heat and cooking by-product and a hood over the cooking unit, the air control system comprising:

an exhaust system associated with the hood and adapted to exhaust air from inside the kitchen to outside the facility along an air flow path defined between the cooking unit to outside the facility through the hood;

a heat sensor adapted to sense cooking heat level in the air flow path; and a fire controller responsive to the heat sensor detecting a heat level greater than normal cooking heat levels and less than a level indicative of fire.

56. The air control system of claim 55 wherein the exhaust system is adapted to exhaust air at a plurality of volume rates, the exhaust system being operatively coupled to the heat sensor whereby to vary the volume rate of air exhausted in correlation to the cooking heat level sensed by the heat sensor.

57. The air control system of claim 55 further comprising a coupling element interconnecting said cooking unit to an energy source, the coupling element being operatively coupled to the fire controller to selectively interrupt said energy source to said cooking unit.

58. For a kitchen forming part of a facility and having a cooking unit adapted to generate heat and cooking by-product and a hood over the cooking unit adapted to exhaust air at a plurality of volume rates from inside the kitchen to outside the facility along an air flow path defined between the cooking unit to outside the facility through the hood, the facility having an ambient air environment outside of the hood and spaced away from the air flow path, an air control system comprising:

means for exhausting air along said air flow path at a first volume rate such that air is drawn out of said ambient air environment through said hood, the first volume rate being below a second, greater volume rate;

first sensing means for sensing temperature of said ambient air environment;

second sensing means for sensing temperature correlated to outside the facility; and means, responsive to (a) the first sensing means for increasing the volume rate of exhausting air along said air flow path toward the second volume rate whereby to increase air drawn out of said ambient air environment through said hood in response to the temperature of said ambient air environment exceeding a desired comfort threshold temperature, and (b) the second sensing means for not responding to the first sensing means when in response to the temperature in the facility is below or exceeding a selected temperature threshold.

59. For a kitchen forming part of a facility and having a cooking unit adapted to generate heat and cooking by-product and a hood over the cooking unit adapted to exhaust air at a plurality of volume rates from inside the kitchen to outside the facility along an air flow path defined between the cooking unit to outside the facility through the hood, the facility having an ambient air environment outside of the hood and spaced away from the air flow path, an air control system comprising:

means for exhausting air along said air flow path at a first volume rate such that air is drawn out of said ambient air environment through said hood, the first volume rate being below a second, greater volume rate; and gas sensing means for sensing an ambient air environment gas level; and means, responsive to the gas sensing means, for increasing the volume rate of exhausting air along said air flow path toward the second volume rate whereby to increase air drawn out of said ambient air environment through said hood in response to the gas level of said ambient air environment exceeding a desired comfort threshold gas level.

60. In a kitchen forming part of a facility and having a cooking unit adapted to generate heat and cooking by-product and a hood over the cooking unit adapted to exhaust air at a plurality of volume rates from inside the kitchen to outside the facility along an air flow path defined between the cooking unit to outside the facility through the hood, the facility having an ambient air environment outside of the hood and spaced away from the air flow path, a method of varying the ambient air environment comprising:

exhausting air along the air flow path at a first volume rate such that air is drawn out of the ambient air environment through the hood; and thereafter, in response to a temperature of the ambient air environment within the kitchen exceeding a desired comfort threshold temperature when the first volume rate is below a second, greater volume rate, increasing the volume rate of exhausting air along the air flow path toward the second volume rate whereby to increase air drawn out of the ambient air environment through the hood.

61. In a kitchen forming part of a facility and having a cooking unit adapted to generate heat and cooking by-product and a hood over the cooking unit adapted to exhaust air at a plurality of volume rates from inside the kitchen to outside the facility along an air flow path defined between the cooking unit to outside the facility through the hood, the facility having an ambient air environment outside of the hood and spaced away from the air flow path, a method of varying the ambient air environment comprising:

exhausting air along the air flow path at a first volume rate such that air is drawn out of the ambient air environment through the hood; and thereafter, in response to a temperature of the ambient air environment exceeding about 75° F. when the first volume rate is below a second, greater volume rate, increasing the volume rate of exhausting air along the air flow path toward the second volume rate whereby to increase air drawn out of the ambient air environment through the hood.

62. In a kitchen forming part of a facility and having a cooking unit adapted to generate heat and cooking by-product and a hood over the cooking unit adapted to exhaust air at a plurality of volume rates from inside the kitchen to outside the facility along an air flow path defined between the cooking unit to outside the facility through the hood, the facility having an ambient air environment outside of the hood and spaced away from the air flow path, a method of varying the ambient air environment comprising:

exhausting air along the air flow path at a first volume rate such that air is drawn out of the ambient air environment through the hood;

thereafter, in response to a temperature of the ambient air environment exceeding a desired comfort threshold temperature when the first volume rate is below a second, greater volume rate, increasing the volume rate of exhausting air along the air flow path toward the second volume rate whereby to increase air drawn out of the ambient air environment through the hood; and sensing temperature correlated to outside the facility and maintaining the first volume rate of air exhaust irrespective of the ambient air environment temperature in response to the sensed temperature being above a selected temperature.

63. The method of claim 62 wherein the selected temperature is about 75° F., the method including increasing toward the second volume rate in response to the temperature of the ambient air environment exceeding about 75° F. unless the sensed temperature is above about 75° F. in which event the first volume rate of air exhaust is maintained irrespective of the ambient air environment temperature.

64. In a kitchen forming part of a facility and having a cooking unit adapted to generate heat and cooking by-product and a hood over the cooking unit adapted to exhaust air at a plurality of volume rates from inside the kitchen to outside the facility along an air flow path defined between the cooking unit to outside the facility through the hood, the facility having an ambient air environment outside of the hood and spaced away from the air flow path, a method of varying the ambient air environment comprising:

exhausting air along the air flow path at a first volume rate such that air is drawn out of the ambient air environment through the hood; and thereafter, in response to a gas level of the ambient air environment exceeding a desired comfort threshold gas level when the first volume rate is below a second, greater volume rate, increasing the volume rate of exhausting air along the air flow path toward the second volume rate whereby to increase air drawn out of the ambient air environment through the hood.

65. The method of claim 64 further comprising sensing the ambient air environment gas level outside of the kitchen.

66. The method of claim 64 including increasing toward the second volume rate in response to the gas level of the ambient air environment exceeding about 100 ppm $CO_2$.

67. In a kitchen forming part of a facility and having a cooking unit adapted to generate heat and cooking by-product and a hood over the cooking unit adapted to exhaust air at a plurality of volume rates from inside the kitchen to outside the facility along an air flow path defined between the cooking unit to outside the facility through the hood, the facility having an ambient air environment outside of the hood and spaced away from the air flow path, a method of varying the ambient air environment comprising:

exhausting air along the air flow path at a first volume rate such that air is drawn out of the ambient air environment through the hood; and thereafter, in response to a parameter of the ambient air environment exceeding a desired comfort threshold when the first volume rate is below a second, greater volume rate selected to be a maximum volume rate for which the hood is adapted to exhaust air, increasing the volume rate of exhausting air along the air flow path toward the second volume rate whereby to increase air drawn out of the ambient air environment through the hood.

68. In a kitchen forming part of a facility and having a cooking unit adapted to generate heat and cooking by-product and a hood over the cooking unit adapted to exhaust air at a plurality of volume rates from inside the kitchen to outside the facility along an air flow path defined between the cooking unit to outside the facility through the hood, the facility having an ambient air environment outside of the hood and spaced away from the air flow path, a method of varying the ambient air environment comprising:

exhausting air along the air flow path at a first volume rate such that air is drawn out of the ambient air environment through the hood; and thereafter, in response to a parameter of the ambient air environment exceeding a desired comfort threshold when the first volume rate is below a second, greater volume rate, increasing the volume rate of exhausting air along the air flow path to the second volume rate whereby to increase air drawn out of the ambient air environment through the hood.

69. In a kitchen forming part of a facility and having a cooking unit adapted to generate heat and cooking by-product and a hood over the cooking unit adapted to exhaust air at a plurality of volume rates from inside the kitchen to outside the facility along an air flow path defined between the cooking unit to outside the facility through the hood, the facility having an ambient air environment outside of the hood and spaced away from the air flow path, a method of varying the ambient air environment comprising:

exhausting air along the air flow path at a first volume rate such that air is drawn out of the ambient air environment through the hood; and thereafter, in response to a parameter of the ambient air environment exceeding a desired comfort threshold when the first volume rate is below a second, greater volume rate, rampingly increasing the volume rate of exhausting air along the air flow path toward the second volume rate whereby to increase air drawn out of the ambient air environment through the hood.

70. In a kitchen forming part of a facility and having a cooking unit adapted to generate heat and cooking by-product and a hood over the cooking unit adapted to exhaust air at a plurality of volume rates from inside the kitchen to outside the facility along an air flow path defined between the cooking unit to outside the facility through the hood, the facility having an ambient air environment outside of the hood and spaced away from the air flow path, a method of varying the ambient air environment comprising:

exhausting air along the air flow path at a first volume rate such that air is drawn out of the ambient air environment through the hood;

thereafter, in response to a parameter of the ambient air environment exceeding a desired comfort threshold when the first volume rate is below a second, greater volume rate, increasing the volume rate of exhausting air along the air flow path toward the second volume rate whereby to increase air drawn out of the ambient air environment through the hood; and decreasing toward the first volume rate in response to the parameter of the ambient air environment no longer exceeding the desired comfort threshold.

71. The method of claim 70 further comprising rampingly decreasing toward the first volume rate.

72. In a kitchen forming part of a facility and having a cooking unit adapted to generate heat and cooking by-product and a hood over the cooking unit adapted to exhaust air at a plurality of volume rates from inside the kitchen to outside the facility along an air flow path defined between the cooking unit to outside the facility through the hood, the facility having an ambient air environment outside of the hood and spaced away from the air flow path, a method of varying the ambient air environment comprising:

exhausting air along the air flow path at a first volume rate such that air is drawn out of the ambient air environment through the hood;

thereafter, in response to a parameter of the ambient air environment exceeding a desired comfort threshold when the first volume rate is below a second, greater volume rate, increasing the volume rate of exhausting air along the air flow path toward the second volume rate whereby to increase air drawn out of the ambient air environment through the hood; and increasing to the second volume rate in response to detection of cooking by-products irrespective of the parameter of the ambient air environment.

73. In a kitchen forming part of a facility and having a cooking unit adapted to generate heat and cooking by-product and a hood over the cooking unit adapted to exhaust air at a plurality of volume rates from inside the kitchen to outside the facility along an air flow path defined between the cooking unit to outside the facility through the hood, the facility having an ambient air environment outside of the hood and spaced away from the air flow path, a method of varying the ambient air environment comprising:

exhausting air along the air flow path at a first volume rate such that air is drawn out of the ambient air environment through the hood;

thereafter, in response to a parameter of the ambient air enviromnent exceeding a desired comfort threshold when the first volume rate is below a second, greater volume rate, increasing the volume rate of exhausting air along the air flow path toward the second volume rate whereby to increase air drawn out of the ambient air environment through the hood; and sensing a heat level in the air path and establishing the first volume rate in correlation to the sensed heat level whereby the first volume rate is variable.

74. The method of claim 73 further comprising sensing a gas level in the ambient air environment and establishing the first volume also in correlation to the sensed gas level.

75. The method of claim 73 further comprising establishing a minimum volume rate and establishing a minimum general heat level below which the first volume rate will be at the minimum volume rate, the method further comprising sensing temperature correlated to outside the facility and increasing the minimum second heat level to a higher level if the sensed outside temperature is below a selected temperature.

76. The method of claim 73 further comprising establishing a minimum volume rate and establishing a minimum sensed heat level below which the first volume rate will be at the minimum rate, the method further comprising sensing temperature correlated to outside the facility and decreasing the minimum volume rate to a lower minimum rate if the sensed outside temperature is below a selected temperature.

77. The method of claim 73 wherein the cooking unit is energized from an energy source, the method comprising interrupting the energy source to the cooking unit in response to the sensed heat level exceeding a first heat threshold.

78. The method of claim 77 wherein the kitchen includes a fire suppression system, the method further including activating the fire suppression system in response to the sensed heat level exceeding a second heat threshold.

79. The method of claim 78 wherein the second heat threshold is higher than the first heat threshold.

80. The method of claim 78 wherein the second heat threshold is defined by the sensed heat level exceeding the first heat threshold for a predetermined duration.

81. The method of claim 73 wherein sensing the heat level includes sensing temperature in the air flow path.

82. In a kitchen having a cooking unit adapted to generate heat and cooking by-product and a hood over the cooking unit adapted to exhaust air from inside the kitchen to outside the facility along an air flow path defined between the cooking unit to outside the facility through the hood, the cooking unit being energized from an energy source, and the kitchen further including a fire suppression system, a method of fire control comprising:

exhausting air along the air flow path;

sensing a heat level in the air flow path;

in response to the sensed heat level in the air flow path exceeding a first heat threshold, interrupting the energy source to the cooking unit; and activating the fire suppression system in response to the sensed heat level exceeding a second heat threshold.

83. The method of claim 82 wherein the second heat threshold is higher than the first heat threshold.

84. The method of claim 82 wherein the second heat threshold is defined by the sensed heat level exceeding the first heat threshold for a predetermined duration.

85. The method of claim 82 wherein sensing the heat level includes sensing temperature in the air flow path.

86. The method of claim 82 wherein the energy source is gas and the cooking unit is coupled to the energy source via a valve in an open state, the method including interrupting the energy source to the cooking unit by closing the valve.

87. The method of claim 82 wherein the energy source is electric and the cooking unit is coupled to the energy source via a relay in a closed open state, the method including interrupting the energy source to the cooking unit by opening the relay.

* * * * *